US007215902B2

(12) United States Patent
Ishii

(10) Patent No.: US 7,215,902 B2
(45) Date of Patent: May 8, 2007

(54) DEVELOPING CARTRIDGE, PROCESS CARTRIDGE, IMAGE FORMING DEVICE, AND SLIDING SEALING ELEMENT

(75) Inventor: Masahiro Ishii, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 205 days.

(21) Appl. No.: 11/018,815

(22) Filed: Dec. 22, 2004

(65) Prior Publication Data

US 2005/0158070 A1 Jul. 21, 2005

(30) Foreign Application Priority Data

Dec. 24, 2003 (JP) ..... 2003-428369

(51) Int. Cl.
*G03G 15/08* (2006.01)

(52) U.S. Cl. ..... 399/103; 399/105

(58) Field of Classification Search ..... 399/103, 399/105

See application file for complete search history.

(56) References Cited

U.S. PATENT DOCUMENTS 6,070,027 A * 5/2000 Kawai et al. ..... 399/105
6,356,723 B1 3/2002 Sato et al.
6,496,668 B2 * 12/2002 Sato et al. ..... 399/105
6,763,209 B2 * 7/2004 Higeta et al.
2002/0090226 A1 * 7/2002 Sato et al. ..... 399/103
2002/0141777 A1 * 10/2002 Kamimura et al. ..... 399/103
2002/0141778 A1 * 10/2002 Itabashi ..... 399/103
2003/0118364 A1 6/2003 Kamimura
2003/0123899 A1 * 7/2003 Kamimura ..... 399/103

FOREIGN PATENT DOCUMENTS

JP 03170573 A * 7/1991
JP A 6-138723 5/1994
JP A 2003-195630 7/2003

* cited by examiner

*Primary Examiner*—Susan Lee
(74) *Attorney, Agent, or Firm*—Oliff & Berridge, PLC

(57) ABSTRACT

A side seal for preventing the leakage of toner out of a housing frame is disposed at each end portion in the axial direction of a developing roller within the housing frame, and is configured of a sponge seal affixed to the housing frame and a sliding sealing element that partially covers the sponge seal. Each sliding sealing element is affixed by double-faced adhesive tapes to an upper attachment portion of a plate spring above the upper edge of the sponge seal and to a lower attachment portion of the housing frame below the lower edge of the sponge seal, without being affixed to the sponge seal, per se.

25 Claims, 18 Drawing Sheets

DEVELOPING CARTRIDGE, PROCESS CARTRIDGE, IMAGE FORMING DEVICE, AND SLIDING SEALING ELEMENT

BACKGROUND OF THE INVENTION

1. Field of the Invention

The present invention relates to a developing cartridge, a process cartridge, and an image forming device.

2. Description of Related Art

A process cartridge is detachably mounted in a conventional image forming device such as a laser printer. A developing cartridge is detachably mounted in the process cartridge. The developing cartridge has a housing in which toner is accommodated. The housing of the developing cartridge is formed with an opening. A developing roller is rotatably supported in the housing at the opening.

When the developing cartridge is mounted on the process cartridge, the developing roller is placed in confrontation with a photosensitive drum in the process cartridge. By rotating the developing roller while in confrontation with the photosensitive drum, an electrostatic latent image formed on the photosensitive drum is developed into a visual toner image. By transferring the toner image onto a sheet of paper, it is possible to form a desired image on the sheet of paper.

The developing cartridge further includes side seals for preventing toner carried on the developing roller from leaking outside from the housing of the developing cartridge. The side seals are disposed at both ends of the developing roller with respect to its axial direction so as to make sliding contact with a circumferential surface of the developing roller at the both ends.

U.S. Pat. No. 6,356,723 and U.S. patent application Publication No. 2003/118364 have proposed a configuration in which the side seal includes: a sponge seal that is formed of urethane sponge and that is affixed to the housing: and a sliding sealing element that is formed of felt or a woven fabric and that is affixed to the upper surface of the sponge seal.

SUMMARY OF THE INVENTION

It is preferable to recycle the developing cartridge in order to protect the environment and to reduce waste.

It is highly likely that the sliding sealing element that makes sliding contact against the developing roller will become damaged. Accordingly, it is preferable to replace the used sliding sealing element with a new one during a recycling stage. If the sliding sealing element is peeled off from the sponge seal, however, the surface of the sponge seal to which the sliding sealing element is affixed will possibly be damaged by the separation, making it necessary to replace the sponge seal as well.

It is troublesome to peel the sponge seal cleanly from the housing and then re-affix the sponge seal. This will make it difficult to increase the efficiency of the recycling. The replacement of the sponge seal leads to an increase in costs.

An objective of the present invention is to provide an improved developing cartridge, an improved process cartridge, and an improved image forming device, in which a sliding sealing element can be replaced with a new one while reducing damage to the sponge seal, enabling an improvement in the efficiency of recycling and also reducing costs.

In order to attain the above and other objects, the present invention provides a developing cartridge, including: a housing; a developing member; and a pair of sealing elements. The housing accommodates developer therein and is formed with an opening. The developing member holds the developer on a surface thereof. The developing member is movably supported in the housing to be exposed at the opening. The pair of sealing elements are provided on the housing at a pair of portions confronting both lengthwise ends of the developing member to prevent leakage of the developer out of the housing by being compressed by the developing member. Each sealing element includes: an elastic seal member; a sliding sealing element; and an adhesive member. The elastic seal member is supported in the housing at a portion confronting a corresponding lengthwise end of the developing member. The sliding sealing element has a first surface and a second surface opposite to the first surface. The first surface has an overlapping region that confronts a part of the elastic seal member and a non-overlapping region that confronts a part of the housing. At least a part of the second surface makes a sliding contact with the surface of the developing member. The adhesive member is provided on at least a part of the non-overlapping region in the first surface of the sliding sealing element thereby being located between the sliding sealing element and the housing. At least a part of the overlapping region in the first surface of the sliding sealing element directly confronts the elastic seal member with no adhesive member being positioned between the at least a part of the overlapping region of the sliding sealing element and the elastic seal member.

According to another aspect, the present invention provides a sliding sealing element, including: a rectangular-shaped flat sheet; and a first double-faced adhesive tape attached to at least a first location on a surface of the rectangular-shaped flat sheet. The first double-faced adhesive tape includes: a first base member made of elastic material and having a pair of opposite surfaces; a pair of first adhesive layers made of adhesive agent and provided on the pair of opposite surfaces of the first base member, one of the pair of first adhesive layers being attached to the rectangular-shaped flat sheet: and a first release paper attached to the other one of the pair of first adhesive layers, the first release paper being releasable from the other one of the pair of first adhesive layers.

BRIEF DESCRIPTION OF THE DRAWINGS

The above and other objects, features and advantages of the invention will become more apparent from reading the following description of the preferred embodiments taken in connection with the accompanying drawings in which:

FIG. 2(*b*) is a side sectional view of a developing cartridge in the process cartridge shown in FIG. 2(*a*);

FIG. 3(*b*) is a perspective view of the sealing structure at the end of the developing cartridge, where a sliding sealing element is overlaid on the sponge seal and the supply roller is attached;

FIG. 6(*b*) illustrates an enlarged view of a portion VIb in FIG. 5 encircled by a two-dot-and-one-chain line;

FIG. 6(*c*) is a cross-sectional view taken along a along a line VIc–Vic in FIG. 4 and illustrates the thickness of a layer-thickness regulating blade and the total thickness of the sliding sealing element and a first double-faced adhesive tape before the developing roller is mounted in the developing cartridge;

FIG. 6(*d*) illustrates how the first double-faced adhesive tape in FIG. 6(*c*) is compressed by the developing roller when the developing roller is mounted in the developing cartridge;

FIG. 6(*e*) illustrates a comparative example of a manner of attaching a sliding sealing element onto a plate spring;

FIG. 6(*f*) is a perspective view of the sliding sealing element before the sliding sealing element is attached on the developing cartridge;

FIG. 6(*g*) is a cross-sectional view of the sliding sealing element of FIG. 6(*f*) taken along the line VIg—VIg in FIG. 6(*f*);

DETAILED DESCRIPTION OF THE PREFERRED EMBODIMENT

Figure 1:
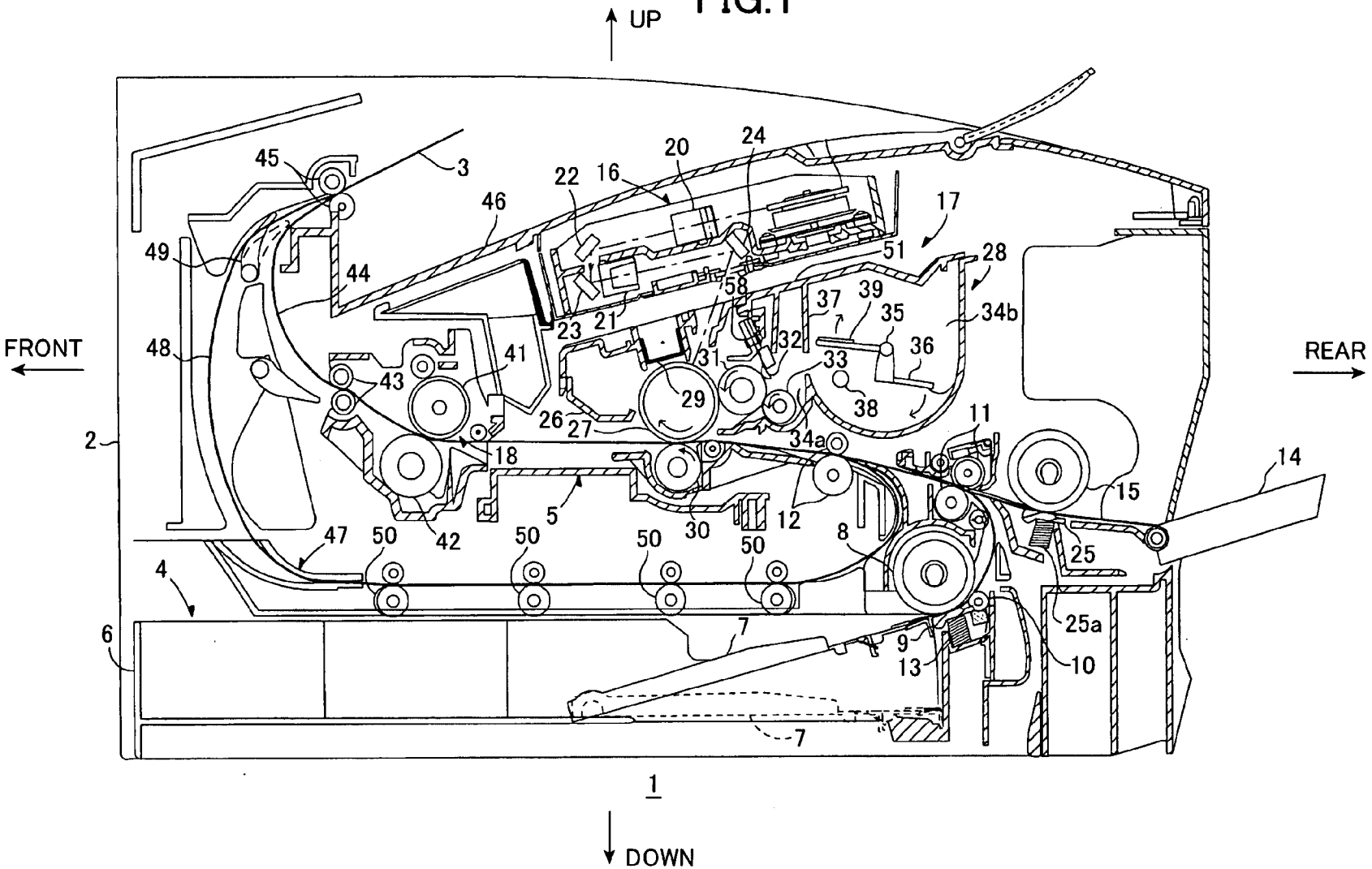
FIG. 1 is a side sectional view of a laser printer according to a preferred embodiment of the invention.

A developing cartridge, a process cartridge, and an image forming device according to a preferred embodiment of the present invention will be described while referring to the accompanying drawings wherein like parts and components are designated by the same reference numerals to avoid duplicating description.

FIG. 1 is a cross-sectional side view of a laser printer 1 according to the preferred embodiment of the present invention.

In the following description, the expressions "front", "rear", "upper", "lower", "right", and "left" are used to define the various parts when the laser printer 1 is disposed in an orientation in which it is intended to be used.

The laser printer 1 includes a main casing 2. The laser printer 1 further includes: a feeder section 4 and an image forming section 5. The feeder section 4 and the image forming section 5 are housed in the main casing 2. The feeder section 4 supplies sheets 3 to the image forming section 5. The image forming section 5 forms desired images on the supplied sheets 3.

The feeder section 4 includes: a paper supply tray 6, a paper pressing plate 7, a sheet supply roller 8, a separating pad 9, paper dust removing rollers 10 and 11, and registration rollers 12. The paper supply tray 6 is detachably mounted in the bottom section of the main casing 2. The paper pressing plate 7 is disposed inside the paper supply tray 6. The sheet supply roller 8 and the separating pad 9 are disposed above one end of the paper supply tray 6. The paper dust removing roller 10 and paper dust removing rollers 11 are disposed downstream of the sheet supply 15 roller 8 in the conveying direction of the paper 3. The registration rollers 12 are disposed downstream of the paper dust removing roller 10 and the paper dust removing rollers 11 in the conveying direction of the paper 3.

A stack of sheets 3 can be mounted on the sheet pressing plate 7. The sheet pressing plate 7 is pivotably supported at its end furthest from the sheet supply roller 8 so that the end of the sheet pressing plate 7 that is the nearest to the sheet supply roller 8 can move vertically. Although not shown in the drawings, a spring for urging the sheet pressing plate 7 upward is provided to the rear surface of the sheet pressing plate 7. Therefore, the sheet pressing plate 7 pivots downward in accordance with increase in the amount of sheets 3 stacked on the sheet pressing plate 7. At this time, the sheet pressing plate 7 pivots around the end of the sheet pressing plate 7 farthest from the sheet supply roller 8, downward against the, urging force of the spring.

The sheet supply roller 8 and the sheet supply pad 9 are disposed in confrontation with each other. A spring 13 is provided beneath the sheet supply pad 9 for pressing the sheet supply pad 9 toward the sheet supply roller 8. Urging force of the spring under the sheet pressing plate 7 presses the uppermost sheet 3 on the sheet pressing plate 7 toward the sheet supply roller 8. According to rotation of the sheet supply roller 8, the uppermost sheet 3 is sandwiched between the sheet supply roller 8 and the separation pad 13. Thereafter, one sheet 3 at a time is separated from the stack and supplied to the paper dust removing rollers 10, 11. The paper dust removing rollers 10, 11 remove paper dust from the supplied sheet 3 and further convey the sheet 3 to the registration rollers 12. The pair of registration rollers 12 performs a predetermined registration operation on the supplied sheet 3, and transport the sheet 3 to a transport position (a location between a photosensitive drum 27 and a transfer roller 30 to be described later) in the image formation section 5.

The feeder section 4 further includes a multipurpose sheet supply mechanism. The multipurpose sheet supply mechanism includes: a multipurpose tray 14, a multipurpose sheet supply roller 15, and a multipurpose sheet supply pad 25. The multipurpose sheet supply roller 15 and the multipurpose sheet supply pad 25 are disposed in confrontation with each other and are for supplying sheets 3 that are stacked on the multipurpose tray 14. A spring 25*a* provided beneath the multipurpose sheet supply pad 25 presses the multipurpose sheet supply pad 25 up toward the multipurpose sheet supply roller 15. Rotation of the multipurpose sheet supply roller 15 moves sheets 3 one at a time from the stack on the multipurpose tray 14 to a position between the multipurpose sheet supply pad 25 and the multipurpose sheet supply roller 15 so that the sheets 3 on the multipurpose tray 14 can be supplied one at a time to the image formation section 5.

The image forming section 5 includes: a scanner unit 16, a process cartridge 17, and a fixing section 18.

The scanner 16 is provided at the upper section of the casing 2 and is provided with a laser emitting portion (not shown), a polygon mirror 19, lenses 20 and 21, and reflection mirrors 22, 23, 24. The laser emitting portion emits a laser beam based on predetermined print data. As indicated by a chain line in FIG. 1, the laser beam passes through or is reflected by the polygon mirror 19, the lens 20, the reflection mirrors 22 and 23, the lens 21, and the reflection mirror 24 in this order so as to irradiate, in a high speed scanning operation, the surface of the photosensitive drum 27 in the process cartridge 17.

Figure 2A:
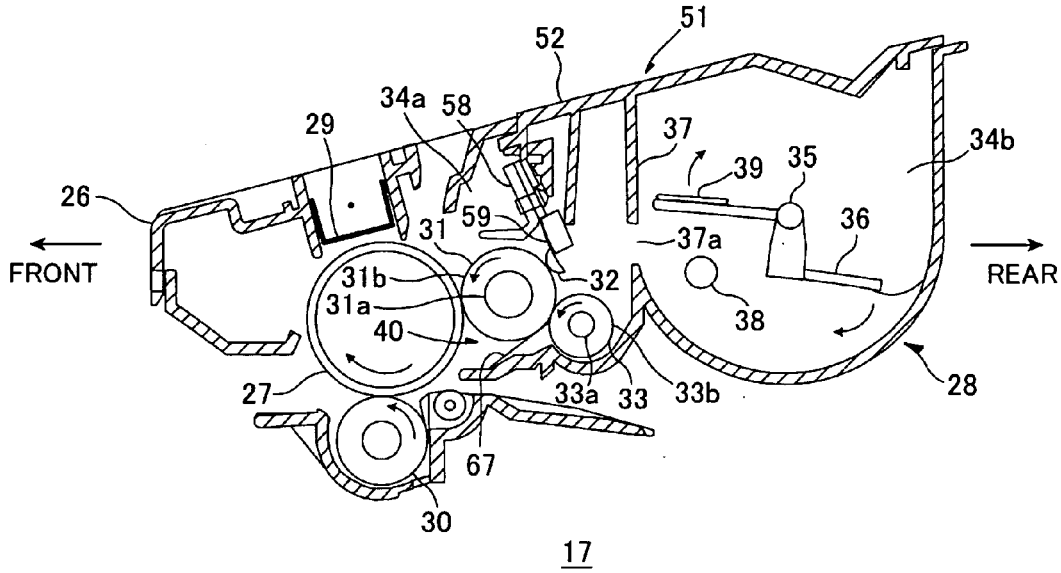
FIG. 2(*a*) is a side sectional view of a process cartridge in the laser printer shown in FIG. 1.
Figure 2B:
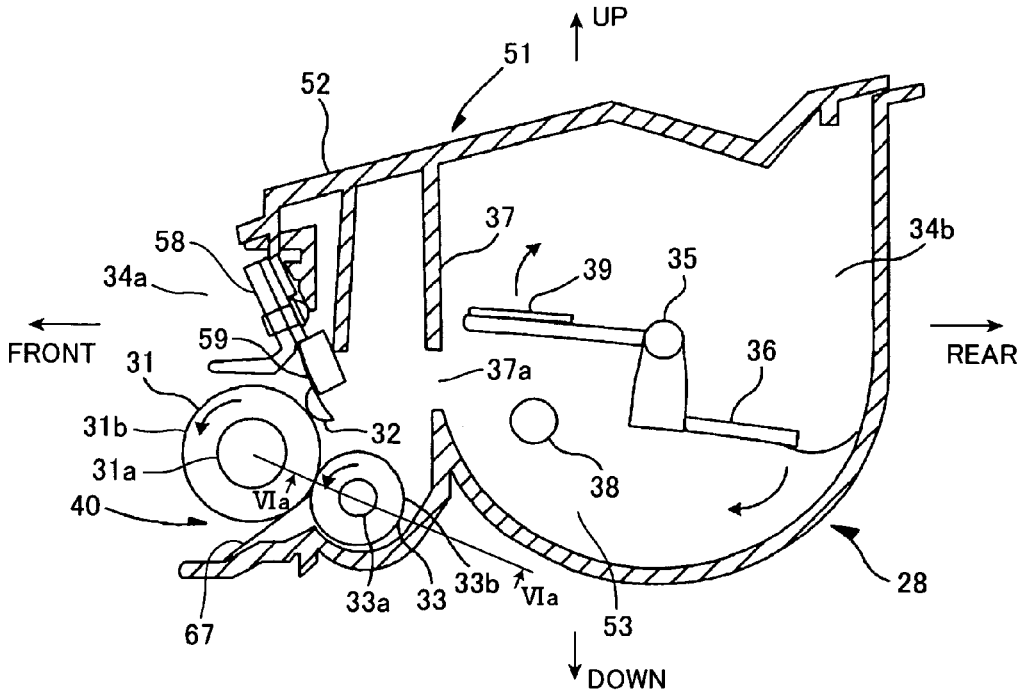

The process cartridge 17 is disposed below the scanner unit 16. The process cartridge 17 includes a drum cartridge 26. The drum cartridge 26 can be attached to and detached from the main casing 2. As shown in FIG. 2(*a*), the drum cartridge 26 houses therein the photosensitive drum 27, a scorotron charge unit 29, and a transfer roller 30.

A developing cartridge 28 is detachably mounted to the drum cartridge 26. As shown in FIG. 2(*b*), the developing is cartridge 28 includes a housing 51. The developing cartridge 28 further includes a supply roller 33, a developing roller 31, and a layer thickness-regulating blade 32, all of which are provided within the housing 51.

The housing 51 has a housing frame 52. The housing frame 52 has a pair of opposite side walls 53. The housing frame 52 is formed entirely as a box shape, and is formed with an opening 40 at its front side. The opening 40 will face the photosensitive drum 27 when the developing cartridge 28 is attached to the drum cartridge 26 as shown in FIG. 2(*a*). A developing chamber 34*a* is formed in the front side of the housing 51. The developing chamber 34*a* is opened through the opening 40. A toner box 34*b* is formed also in the housing 51. The toner box 34*b* is located in the rear side of the developing chamber 34*a*. A partitioning plate 37 is provided between the developing chamber 34*a* and the toner box 34*b*. A toner supply port 37*a* is defined as an opening formed through a lower part of the partitioning plate 37, to thereby allow communication between the developing chamber 34*a* and the toner box 34*b*.

A pair of windows 38 are provided on the side walls 53 at a location that the windows 38 face each other through the toner box 34*b*. The windows 38 are used for checking the amount of remaining toner in the toner box 34*b*.

The toner box 34*b* contains positively charged nonmagnetic single-component toner as a developing agent. The toner used in this embodiment is a polymerized toner obtained through copolymerization of styrene-based monomers, such as styrene, and acryl-based monomers, such as acrylic acid, alkyl(C1–C4)acrylate, or alkyl(C1–C4)methacrylate, using a known polymerization method, such as suspension polymerization. The particle shape of such a polymerized toner is spherical, and thus the polymerized toner has excellent fluidity and is capable of forming high quality image.

A coloring agent, such as carbon black, and wax is added to the polymerized toner. An external additive, such as silica, is also added to the polymerized toner to improve fluidity. The particle size of the polymerized toner is approximately 6–10 μm.

The toner in the toner box 34*b* is stirred by an agitator 36 supported by a rotating shaft 35 provided at a central portion of the toner box 34*b*, and is discharged through the toner supply port 37*a* toward the developing chamber 34*a*. The window 38 is wiped clean by a cleaner 39 supported by the rotating shaft 35.

The supply roller 33 and the developing roller 31 are mounted in the developing chamber 34*a*. The supply roller 33 is disposed in the lower-front side of the toner supply port 37*a* and is rotatable in a counterclockwise direction. The supply roller 33 is formed by covering a metallic shaft 33*a* with a conductive sponge material 33*b*.

The developing roller 31 is disposed in the upper-front side of the supply roller 33 and is rotatable also in a counterclockwise direction. The developing roller 31 confronts the supply roller 33. The developing roller 31 is located as being exposed in the opening 40.

As shown in FIG. 2(*b*), the developing roller 31 is formed by covering a metallic roller shaft 31*a* with a roller portion 31*b* made of an electrically conductive elastic rubber material 31*b*. More specifically, the roller portion 31*b* is made of an electrically conductive urethane or silicone rubber, containing fine carbon particles, and is coated with a urethane or silicone rubber containing fluorine.

A predetermined developing bias is applied to the developing roller 31 with respect to the photosensitive drum 27.

The supply roller 33 and the developing roller 31 are disposed in contact with each other so that they are compressed against each other to an appropriate extent.

A metallic plate spring 59 is mounted in the developing chamber 34*a* as being exposed in the upper portion of the opening 40. The plate spring 59 is located near to the developing roller 31. The plate spring 59 is supported at its one base end to the housing frame 52 by a support member 58. A layer thickness-regulating blade 32 is provided on a distal end of the plate spring 59 opposite to the base end, at which the plate spring 59 is attached to the housing frame 52. The layer thickness-regulating blade 32 extends in an axial direction of the developing roller 31. The layer thickness-regulating blade 32 is formed from an electrically insulating silicone rubber into a semicircular shape in section.

The layer thickness-regulating blade 32 is pressed against the developing roller 31 from the upper rear side of the developing roller 31 by the resilient force of the plate spring 59, thereby regulating the thickness of a toner layer formed on the surface of the developing roller 31.

The rotation of the supply roller 33 supplies the developing roller 31 with toner that has been discharged through the toner supply port 37*a*. At this time, the toner is triboelectrically charged to a positive charge between the supply roller 33 and the developing roller 31. Then, as the developing roller 31 rotates, the toner supplied onto the developing roller 31 moves between the developing roller 31 and the layer-thickness regulating blade 32. This reduces thickness of the toner on the surface of the developing roller 31 down to a thin layer of uniform thickness.

As shown in FIG. 2(*a*), the photosensitive drum 27 is disposed in front of and in confrontation with the developing roller 31. The photosensitive drum 27 is supported rotatably in a clockwise direction. The photosensitive drum 27 includes a drum-shaped member and a surface layer. The drum-shaped member is electrically grounded. The surface layer is formed from a photosensitive layer that is made from polycarbonate and that has a positively charging nature.

The scorotoron charge unit 29 is disposed above the photosensitive drum 27 and is spaced away from the photosensitive drum 27 by a predetermined distance so as to avoid direct contact with the photosensitive drum 27. The scorotron charge unit 29 is a positive-charge scorotron type charge-unit for generating a corona discharge from a charge wire made from, for example, tungsten. The scorotoron charge unit 29 forms a blanket of positive-polarity charge on the surface of the photosensitive drum 27.

As shown in FIG. 1, as the photosensitive drum 27 rotates, the scorotoron charge unit 29 first forms a blanket of positive charge on the surface of the photosensitive drum 27, and then the surface of the photosensitive drum 27 is exposed to high speed scan of the laser beam from the scanner unit 16. The electric potential of the positively is charged surface of the photosensitive drum 27 drops at positions exposed to the laser beam. As a result, an electrostatic latent image is formed on the photosensitive drum 27 based on print data.

Next, an inverse developing process is performed. That is, as the developing roller 31 rotates, the positively-charged toner borne on the surface of the developing roller 31 is brought into contact with the photosensitive drum 27. Because of the developing bias voltage applied to the developing roller 27, the toner on the developing roller 31 is supplied to lower-potential areas of the electrostatic latent image on the photosensitive drum 27. As a result, the toner is selectively borne on the photosensitive drum 27 so that the electrostatic latent image is developed into a visible toner image.

The transfer roller 30 is rotatably supported at a position below and in confrontation with the photosensitive drum 27. The transfer roller 30 is rotatably supported in the drum cartridge 26. The transfer roller 30 is supported rotatably in a counterclockwise direction. The transfer roller 30 includes a metal roller shaft and a roller portion covering the roller shaft and made of conductive elastic rubber.

At times of toner image transfer, the transfer roller 30 is applied with a predetermined transfer bias. The visible toner image borne on the surface of the photosensitive drum 27 is transferred onto a sheet 3 as the sheet 3 from the registration rollers 12 passes between the photosensitive drum 27 and the transfer roller 30.

The fixing section 18 is disposed in front of the process cartridge 17 and downstream of the same in the conveying direction of the paper 3. The fixing section 18 includes a heating roller 41, a pressure roller 42 applying pressure to the heating roller 41, and transport rollers 43. The transport rollers 43 are disposed downstream of the heating roller 41 and the pressure roller 42. The pressure roller 42 is disposed below the heating roller 41 in confrontation with the heating roller 41, and is compressed against the heating roller 41.

The heating roller 41 is made of metal and encloses a halogen lamp (heater) therein. In the fixing section 18, the heat generated by the halogen lamp thermally fixes the toner, which has been transferred to the sheet 3 by the process cartridge 17, onto the sheet 3 while the sheet 3 passes through between the heating roller 41 and the pressure roller 42. Thereafter, the sheet 3 is transferred to a sheet discharging path 44 by the transport rollers 43. The sheet 3 transported to the sheet discharging path 44 is conveyed to discharge rollers 45, which in turn discharge the sheet 3 onto a discharge tray 46.

The laser printer 1 is further provided with an inverting transport section 47 for inverting sheets 3 that have been printed on once and for returning the sheets 3 to the image forming section 5 so that images can be formed on both sides of the sheets 3. The inverting transport section 47 includes the sheet-discharge rollers 45, an inversion transport path 48, a flapper 49, and a plurality of inversion transport rollers 50.

The sheet-discharge rollers 45 are a pair of rollers that can be rotated selectively forward or in reverse. The sheet-discharge rollers 45 are rotated forward to discharge sheet 3 onto the sheet-discharge tray 46 and rotated in reverse when sheets 3 are to be inverted.

The inversion transport rollers 50 are disposed below the image forming section 5. The inversion transport path 48 extends vertically between the sheet-discharge rollers 45 and the inversion transport rollers 50. The upstream end of the inversion transport path 48, is located near the sheet-discharge rollers 45 and the downstream end is located near the inversion transport rollers 50 so that sheets 3 can be transported downward from the sheet-discharge rollers 45 to the inversion transport rollers 50.

The flapper 49 is swingably disposed at the junction between the sheet-discharge path 44 and the inversion transport path 48. By activating or deactivating a solenoid (not shown), the flapper 49 can be selectively swung between the orientation shown in broken line and the orientation shown by solid line in FIG. 1. The orientation shown in solid line in FIG. 1 is for transporting sheets 3 that have one side printed to the sheet-discharge rollers 45. The orientation shown in broken line in FIG. 1 is for transporting sheets from the sheet-discharge rollers 45 into the inversion transport path 48, rather than back into the sheet-discharge path 44.

The inversion transport rollers 50 are aligned horizontally at positions below the image forming section 5 and above the sheet supply tray 6. One pair of inversion transport rollers 50 that is farthest upstream is disposed near the rear end of the inversion transport path 48. Another pair of inversion transport rollers 50 that is located farthest downstream is disposed below the registration rollers 12.

The inverting transport unit 47 operates in the following manner when a sheet 3 is to be formed with images on both sides. A sheet 3 that has been formed an one side with an image is transported by the transport rollers 43 from the sheet-discharge path 44 to the sheet-discharge rollers 45. The sheet-discharge rollers 45 rotate forward with the sheet 3 pinched therebetween until almost all of the sheet 3 is transported out from the laser printer 1 and over the sheet-discharge tray 46. The forward rotation of the sheet-discharge rollers 45 is stopped once the rear-side end of the sheet 3 is located between the sheet-discharge rollers 45. Then, the sheet-discharge rollers 45 are driven to rotate in reverse while at the same time the flapper 49 is switched to, change transport direction of the sheet 3 toward the inversion transport path 48. As a result, the sheet 3 is transported into the inversion transport path 48 with its leading and trailing ends being reversed from the original state. The flapper 49 reverts to its initial position once transport of the sheet 3 to the inversion transport path 48 is completed. That is, the flapper 49 switches back to the position for transporting sheets from the transport rollers 43 to the sheet-discharge rollers 45. Next, the inverted sheet 3 is transported through the inversion transport path 48 to the inversion transport rollers 50 and then from the inversion transport rollers 50 to the registration rollers 12. The registration rollers 12 align the front edge of the sheet 3. Afterward, the sheet 3 is transported toward the transfer position in the image formation section 5. At this time, the upper and lower surfaces of the sheet 3 are reversed from the first time that an image has been formed on the sheet 3 so that an image can be formed on the other side as well. In this way, images are formed on both sides of the sheet 3.

The laser printer 1 uses the developing roller 31 to collect residual toner that remains on the surface of the photosensitive drum 27 after toner is transferred onto the sheet 3 via the transfer roller 30. In other words, the laser printer 1 uses a "cleanerless development method" to collect the residual toner. By using the cleanerless development method to collect residual toner, there is no need to provide a separate member, such as a blade, for removing the residual toner or an accumulation tank for the waste toner. Therefore, the configuration of the laser printer can be simplified.

Figure 3A:
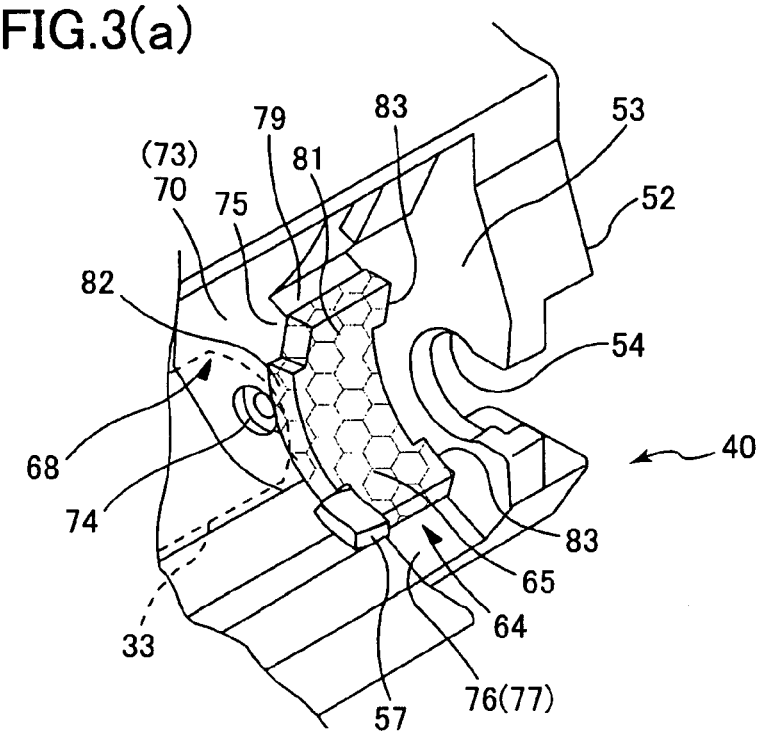
FIG. 3(*a*) is a perspective view of a sealing structure at the end of the developing cartridge shown in FIG. 2(*b*), where a blade side seal is not yet affixed, a sponge seal of a side seal is affixed, and the supply roller is not yet mounted.
Figure 3B:
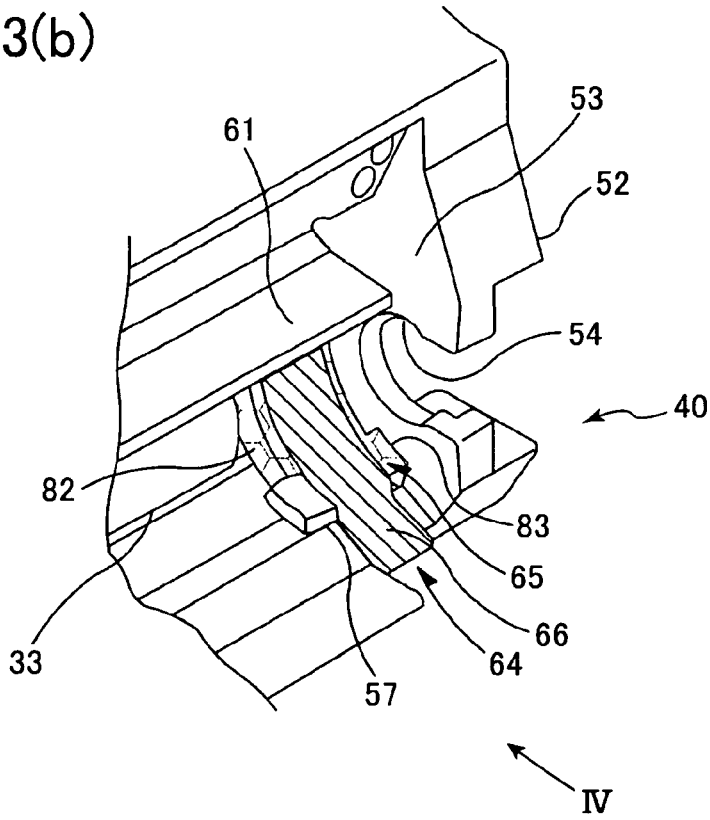

As shown in FIG. 2(*b*), FIG. 3(*a*) and FIG. 3(*b*), the housing frame 52 is open at the opening 40. Each of the opposite side walls 53 of the housing frame 52 is provided with a cutout 54 for mounting the developing roller 31 in the housing frame 52. The cutout 54 is formed in substantially a U-shape so as to receive the roller shaft 31*a* of the developing roller 31. In this way, the developing roller 31 is rotatably mounted in the housing 51 with the axial ends of the roller shaft 31 being rotatably supported in the cutouts 54 on the opposite side walls 53.

A supply roller mounting portion 68 is provided in the rear side of the cutout 54 in each of the opposite side walls 53.

Figure 5:
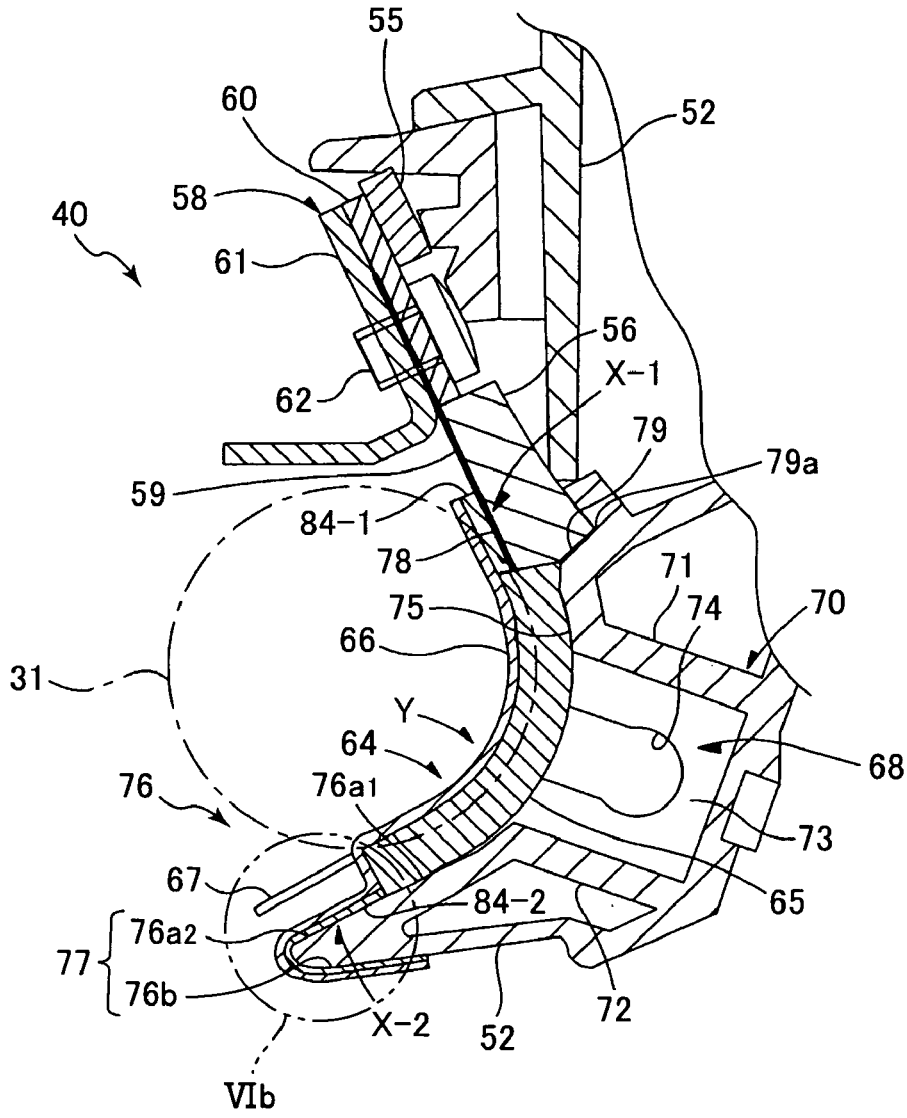
FIG. 5 is a side sectional view of the sealing structure, taken along a line V—V in FIG. 4.
Figure 6A:
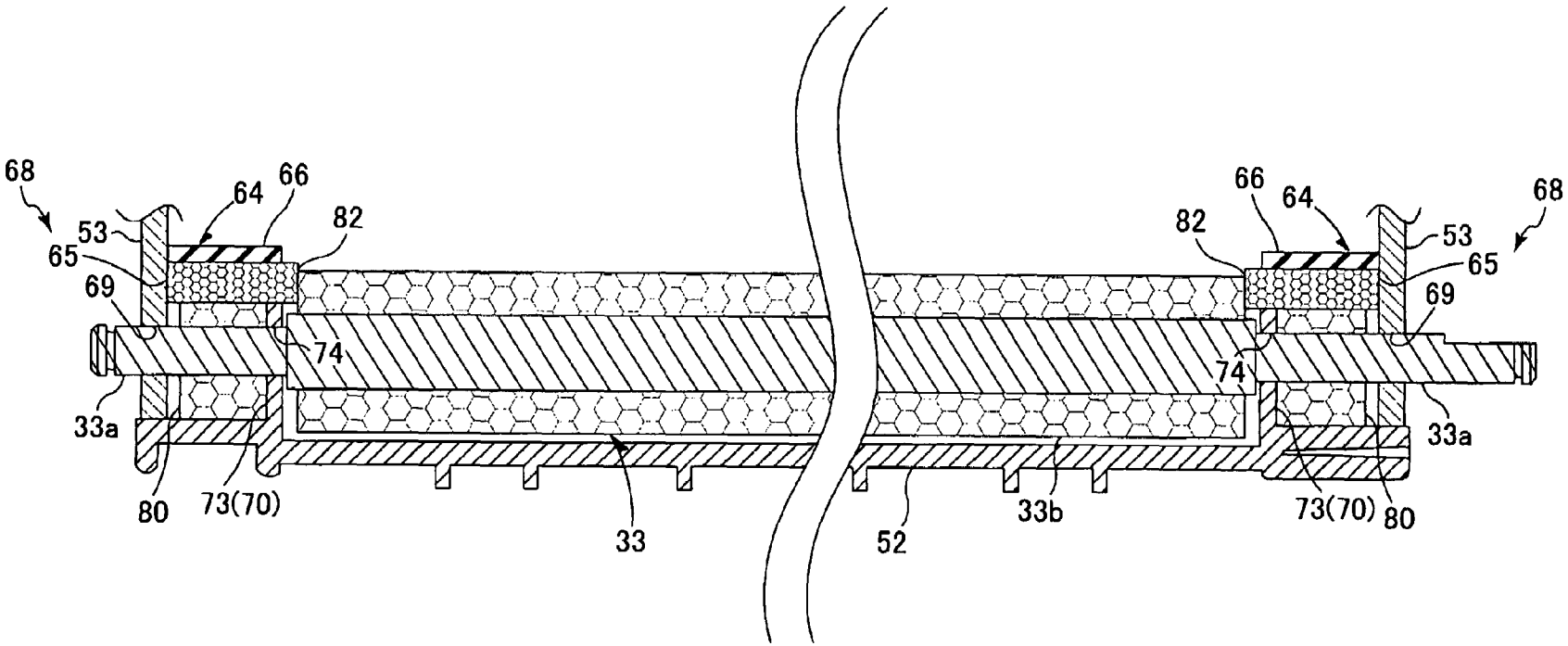
FIG. 6(*a*) is a cross-sectional view of the sealing structure and the supply roller in the developing cartridge, taken along a line VIa—VIa in FIG. 2(*b*), where showing of the developing roller is omitted.
Figure 6B:
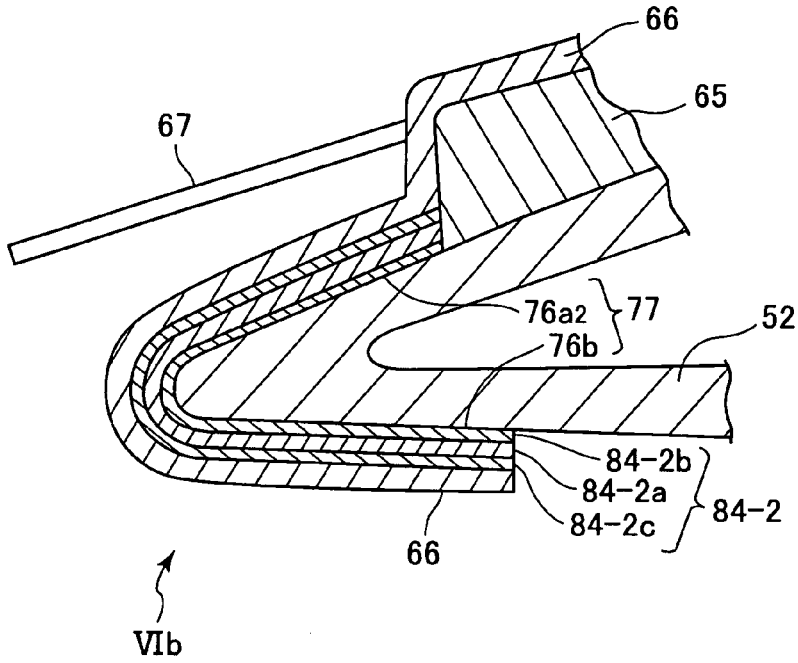
Figure 6C:
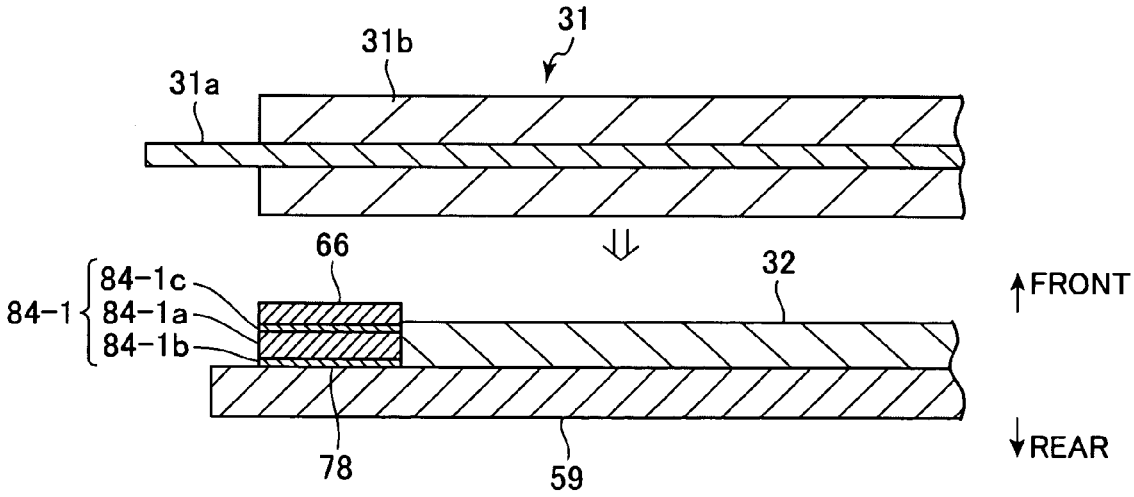
Figure 6D:
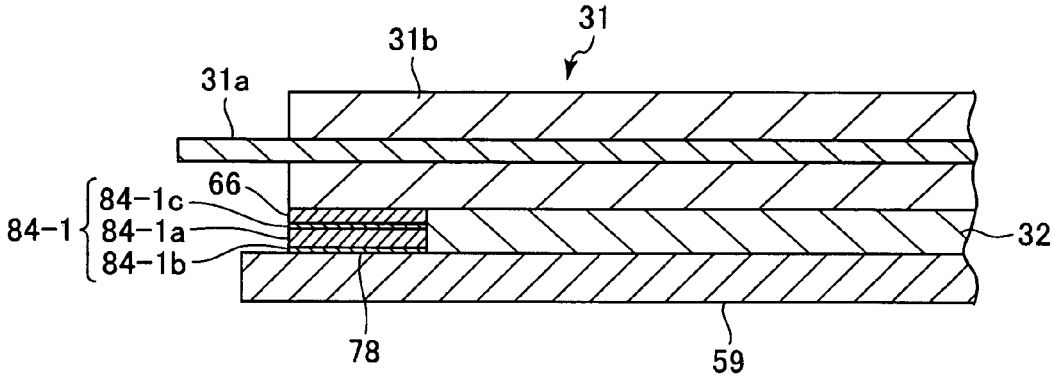
Figure 6E:
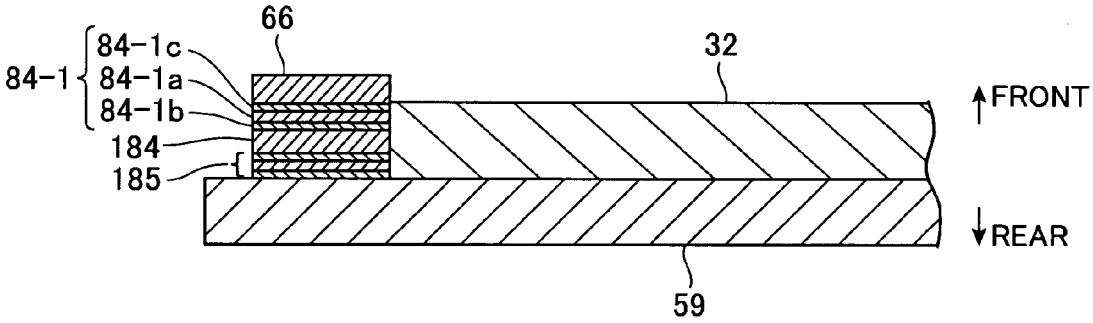
Figure 6F:
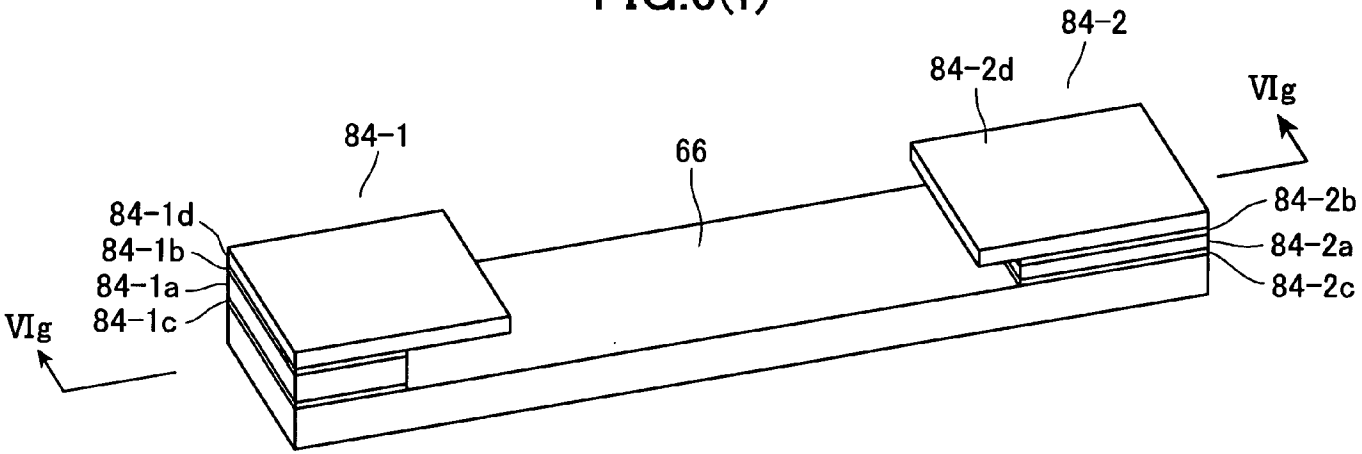
Figure 6G:
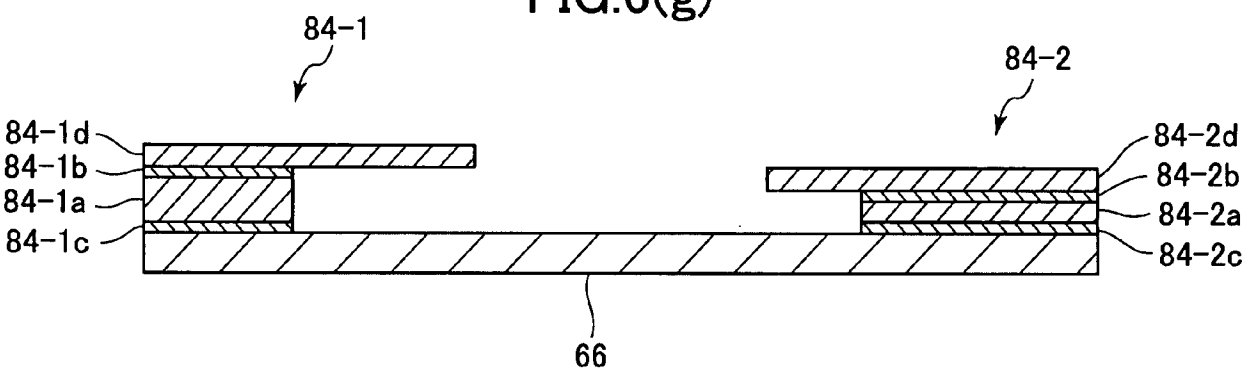

As shown in FIG. 3(*a*), FIG. 5, and FIG. 6(*a*), the housing frame 52 has a supply roller support plate 70 on the inner side of each of the opposite side walls 53 in the widthwise direction of the housing 51. The supply roller support wall 70 on each side includes: an inner side plate 73, an upper plate 71, and a lower plate 72, all of which are combined together into a substantially U-shape that is open at the front side thereof. The inner side plate 73 is located inside the housing 51 at a specified distance away from the corresponding side wall 53. The upper plate 71 and the lower plate 72 connect the inner side plate 73 to the corresponding side wall 53. The inner side plate 73 is formed with a notch 74. The side wall 53 is formed with a through-hole 69. The notch 74 on the inner side plate 73 confronts the through-hole 69 on the side wall 53 through the space surrounded by the inner side plate 73, the upper plate 71, the lower plate 72, and the side plate 53. On each of the opposite sides of the housing frame 52, a corresponding end of the shaft 33*a* in the supply roller 33 rotatably passes through the notch 74 in the inner side plate 73 and the through-hole 69 in the side wall 53. In this way, the supply roller 33 is rotatably supported by the supply roller support plates 70 and the side walls 53 on the opposite sides of the housing frame 52.

As shown in FIG. 6(*a*), when the supply roller 33 is thus mounted in the housing 51, each end surface of the sponge material 33*b* in the supply roller 33, with respect to the axial direction of the supply roller 31, makes contact with a sponge seal 65 in a side seal 64 to be described later. With this contact, the supply roller 33 is positioned in its axial direction.

A roller shaft seal member 80, made of a sponge, is fitted around the shaft 33*a* at a location between the inner side plate 73 and the side wall 53 at each of the opposite sides of the housing frame 52, so as to prevent toner leakage through the notches 74 and the through-holes 69.

As shown in FIG. 3(*a*) and FIG. 5, the housing frame 52 has an intermediate attachment portion 75 and a lower attachment, portion 76, and a blade side seal support portion 79, at each of the opposite sides of the housing frame 52. The intermediate attachment portion 75, lower attachment portion 76, and blade side seal support portion 79 are provided on the inner side of each of the opposite side walls 53 in the widthwise direction of the housing 51. The intermediate attachment portion 75, lower attachment portion 76, and blade side seal support portion 79 are located adjacent to the cutout 54.

The intermediate attachment portion 75 extends upwardly from the front side of the upper plate 71, and is finally connected with the blade side seal support portion 79. The housing frame 52 is curved at the intermediate attachment portion 75 following the circumferential surface of the developing roller 31 when the developing roller 31 is mounted in the housing 51. The housing frame 52 has a right-angled corner 79*a* in the middle of the blade side seal support portion 79.

The lower attachment portion 76 extends forwardly and downwardly from the front side of the lower plate 72. The housing frame 52 is curved also at the lower attachment portion 76 following the circumferential surface of the developing roller 31 when the developing roller 31 is mounted in the housing 51. The lower attachment portion 76 is then folded back and then further extends rearwardly to some extent.

In other words, the lower attachment portion 76 includes: an upperside lower attachment portion 76*a* and an underside lower attachment portion 76*b*. The upperside lower attachment portion 76*a* extends forwardly and downwardly from the front side of the lower plate 72. The housing frame 52 is curved at the upperside lower attachment portion 76*a* following the circumferential surface of the developing roller 31 when the developing roller 31 is mounted in the housing 51. The upperside lower attachment portion 76*a* finally ends at, its lower front edge. The underside lower attachment portion 76*b* extends rearwardly from the front end of the upperside lower attachment portion 76*a*.

As will be described later, the upperside lower attachment portion 76*a* is divided into two regions: an upper region 76*a*1, onto which a part of the sponge seal 65 is attached via a double-faced adhesive tape (not shown); and a lower region 76*a*2, onto which no part of the sponge seal 65 is attached. A lower end attachment portion 77 is defined as a region covering; the lower region 76*a*2 in the upperside lower attachment portion 76*a*; and the underside lower attachment portion 76*b*.

Figure 4:
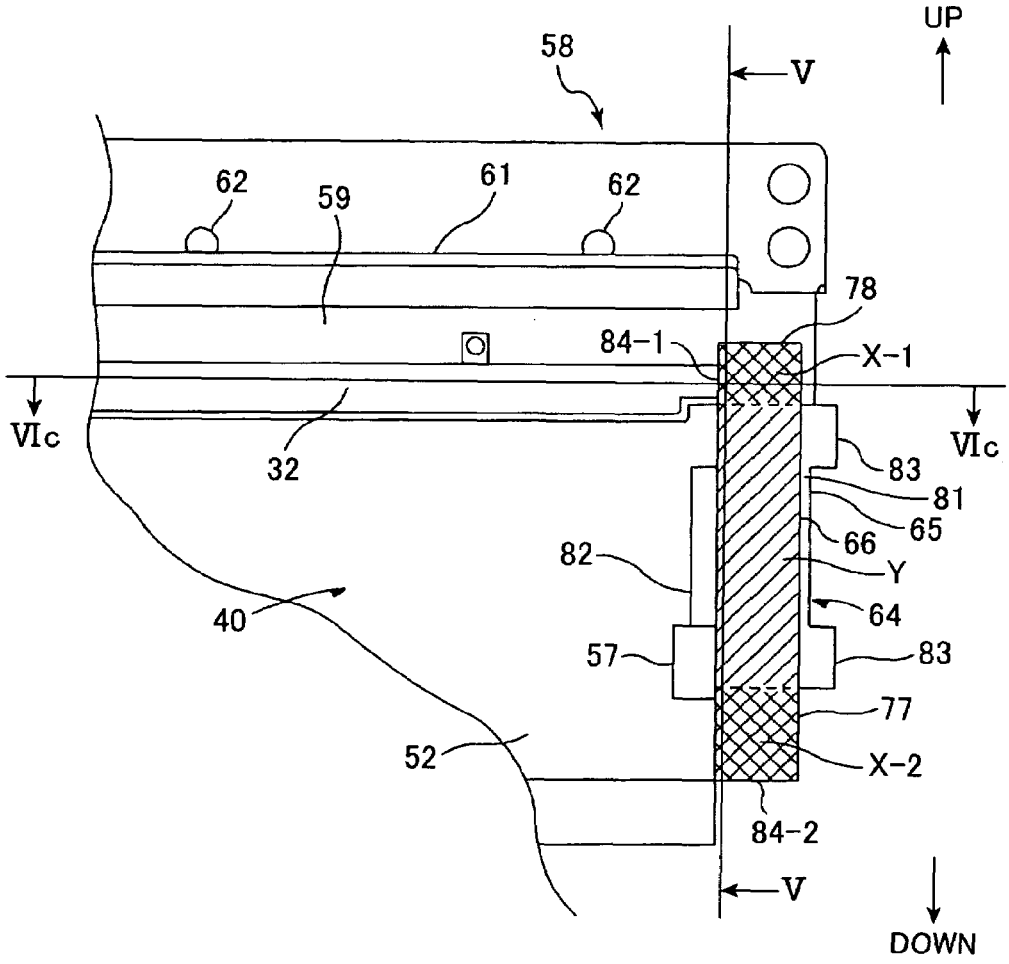
FIG. 4 is a front view of the end of the developing cartridge seen from a direction indicated by an arrow IV in FIG. 3(*b*)

As shown in FIG. 4, the plate spring 59 is provided in the housing 51 to extend over the entire width of the housing frame 52 at the upper side of the opening 40. The support member 58 is provided in the housing 51 to extend also over the entire width of the housing frame 52 at the upper side of the opening 40. As shown in. FIG. 5, the support member 58 includes a back support member 60 and a front support member 61.

The plate spring 59 is formed in a substantially long, thin rectangular shape and is located above the developing roller 31 in the opening 40. The plate spring 59 extends along the axial direction of the developing roller 31. The lower edge of the plate spring 59 faces an upper rear portion of the developing roller 31. A pair of upper attachment portions 78 are defined on the front surface of the plate spring 59 at both end portions of the plate spring 59 with respect to the axial direction of the developing roller 31. Each upper attachment portion 78 is located at the lower edge of the plate spring 59.

The layer-thickness regulating blade 32 is provided on the lower edge of the plate spring 59. The layer-thickness regulating blade 32 is provided on the plate spring 59 to extend along the axial direction of the developing roller 31 over the entire length of the plate spring 59 except for the upper attachment portions 78. Accordingly, the layer-thickness regulating blade 32 extends over a region defined between the pair of upper attachment portions 78 along the axial direction of the developing roller 31.

The back support member 60 is formed in a substantially long, thin rectangular shape plate and extends along the axial direction of the developing roller 31. The front support member 61 is formed also in a substantially long, thin rectangular shape plate, extends along the axial direction of the developing roller 31, and has an L-shape in cross section. The support member 58 is secured to the housing frame 52 at a location above the opening 40 using screws 62, with the upper portion of the plate spring 59 being sandwiched between the back support member 60 and the front support member 61. Accordingly, the back support member 60 confronts the upper portion of the rear surface of the plate spring 59, while the front support member 61 confronts the upper portion of the front surface of the plate spring 59.

As shown in FIG. 2(*b*), a lower film 67, made of a polyethylene terephthalate (PET) sheet or an urethane rubber film, is affixed with a double-faced adhesive tape (not shown) entirely to an upper surface of a lower front edge of the housing frame 52. The lower film 67 prevents toner from leaking from the lower part of the housing frame 52.

Sealing structures are disposed at both ends of the inside of the housing frame 52 with respect to the axial direction of the developing roller 31. When the developing roller 31 is mounted in position in the developing cartridge 28, the sealing structures prevent toner carried on the developing roller 31 from leaking from each end of the developing roller 31.

Next will be described, with reference to FIG. 3(*a*) through FIG. 6(*g*), the sealing structure at each end of the inside of the developing cartridge 28 with respect to the axial direction of the developing roller 31. FIG. 3(*a*) through FIG. 5 and FIG. 6(*b*) through FIG. 6(*e*) show structural elements only at one end of the inside of the developing cartridge 26, and the following descriptions are made based on one end of the inside of the developing cartridge 28. The structural elements at the one end are identical to those at the other end.

As shown in FIG. 3(*a*), FIG. 3(*b*), and FIG. 5, the sealing structure, including the side seal 64, a lower side seal 57, an upper side seal 55, and a blade side seal 56, are provided adjacent to a position of the side wall 53 where the cutout 54 is formed. All of the side seal 64, lower side seal 57, upper side seal 55, and blade side seal 56 reliably prevent toner from leaking from each end of the developing roller 31 when the developing roller 31 is mounted in position in the developing cartridge 28.

The upper side seal 55 is made of a sponge material (e.g. urethane) formed in a substantially rectangular shape having a fixed thickness. The upper side seal 55 is disposed at an upper portion of each widthwise end of the housing frame 52 facing the rear surface of the back support member 60, and is affixed to the housing frame 52 with double-faced adhesive tape (not shown).

The blade side seal 56 is made of a sponge material (e.g. urethane) formed in a substantially rectangular shape having a fixed thickness. The blade side seal 56 is provided at a location between the rear surface of the plate spring 59 and the blade side seal support portion 79 on the housing frame 52 and below the upper side seal 55, and is affixed to the rear surface of the plate spring 59. Thus, the blade side seal 56 is provided on the rear surface of the plate spring 59.

As shown in FIG. 3(*a*) and 3(*b*), the side seal 64 is provided adjacent to a portion of the side wall 53, where the cutout 54 is formed, so as to make sliding contact with the circumferential surface of the developing roller 31 when the ends of the developing roller 31 are rotatably supported by the cutout 54.

The lower side seal 57 made of a sponge material. (e.g. urethane) is formed in a substantially rectangular shape having a fixed thickness, is disposed adjacent to an inner side of the side seal 64, and is affixed to a lower part of the housing frame 52 with double-faced adhesive tape (not shown). Provision of the lower side seal 57 can prevent the toner from leaking from a boundary between the side seal 64 and the lower film 67.

Next will be described the side seal 64 with a greater detail.

The side seal 64 is provided at a region covering the upper attachment portion 76 on the plate spring 59 (FIG. 4) and the intermediate attachment portion 75 and the lower attachment portion 76 of the housing frame 52 (FIG. 5).

The side seal 64 includes: a sponge seal 65 (FIG. 3(*a*)) which is elastically compressed against the developing roller 31 when the developing roller 31 is mounted in the housing 51; and a sliding sealing element 66 (FIG. 3(*b*)) which is overlaid partly on the sponge seal 65 and performs a sliding contact against the circumferential surface of the developing roller 31.

The sponge seal 65, providing an urging force, is made of an elastic foamed material, i.e., a sponge material, such as urethane. More specifically, the sponge seal 65 is made of a high density, microcellular urethane foam (trade name: PORON, manufactured by Rogers Inoac Corporation), which has a comparatively great rigidity and resists permanent deformation among various sponge materials. The hardness of the microcellular urethane foam is 0.001 to 0.05 MPa (Mega-Pascal) under 25% compressive load, and preferably 0.005 to 0.025 MPa. The sponge seal 65 is formed in a substantially rectangular shape having a certain thickness to generate a fixed pressing force when compressed by the developing roller 31 mounted in position.

The sponge seal 65 includes a base portion 81, an inner projecting portion 82, and a pair of outer projecting portions 68, which are formed integrally as shown in FIG. 3(*a*). The base portion 81 is formed in a substantially rectangular shape, and a front surface thereof, which faces the opening 40, is used as a surface onto which the sliding sealing element 66 is overlaid. The inner projecting portion 82 is formed in a rectangular shape projecting from a center of the base portion 61, with respect to a rotational direction of the developing roller 31, toward the center of the developing roller 31 along its axial direction. The outer projecting portions 83 are formed in rectangular shapes projecting from both ends of the base portion 81, with respect to the rotational direction of the developing roller 31, toward the end of the developing roller 31 along its axial direction.

The sponge seal 65 is disposed in such a manner that the outer projecting portions 83 make contact with the sidewall 53 of the housing frame 52, thereby positioning the sponge seal 65 with respect to the width of the housing frame 52. An upper end of the sponge seal 65 is pressed against a lower end of the blade side seal 56 as shown in FIG. 5. The sponge seal 65 is located side by side with the lower side seal 57 in the widthwise direction of the housing frame 52, and is in intimate contact with thee lower side seal 57. The lower end of the inner projecting portion 82 is pressed against the upper end of the lower side seal 57. In this way, the sponge seal 65 is positioned also with respect to the rotational direction of the developing roller 31, that is, with respect to a direction orthogonal to the widthwise direction of the housing frame 52.

The sponge seal 65 is affixed to the housing frame 52 by double-faced adhesive tape (not shown), extending to cover both of the intermediate attachment portion 75 and the upper region 76*a*1 in the lower attachment portion 76, spanning the supply roller support portion 68. Affixing the sponge seal 65 in this manner ensures that the upper edge portion of the sponge seal 65 in the lengthwise direction thereof is located next to the upper attachment portion 78 on the plate spring 59 and that the lower edge portion of the sponge seal 65 in the lengthwise direction thereof is located next to the lower region 76*a*2 in the lower attachment portion 76 on the housing frame 52.

By making the upper end of the sponge seal 65 be pressed against the blade side seal 56, the sponge materials make contact with each other to reliably prevent toner leakage in the boundary between the sponge seal 65 and the blade side seal 56. By making the lower end of the sponge seal 65 and the lower side seal 57 slightly overlap each other in the widthwise direction thereof, the sponge materials make contact with each other, thereby preventing toner leakage in the boundary between the sponge seal 65 and the lower side seal 57.

As shown in FIG. 3(*b*), the sliding sealing-element 66 is formed into a substantially rectangular-shaped elongated flat sheet, and is made of a fluorine-based felt, such as a polytetrafluoroethylene felt. The sliding sealing element 66 is mounted on the housing 61 as being oriented with its widthwise direction extending along the axial direction of the developing roller 31. The width of the sliding sealing element 66 is uniform over the entire length of the sealing element 66.

As shown in FIG. 3(*b*) and FIG. 4, the sliding sealing element 66 is overlaid on a part of the sponge seal 65. More specifically, as shown in FIG. 5, the sliding sealing element 66 extends in the rotational direction of the developing roller 31 to extend along: the entire upper attachment portion 78 on the plate spring 59; the entire length of the base portion 81 of the sponge seal 65 in the lengthwise direction thereof; and the entire length of the lower end attachment portion 77 on the housing frame 52. It is noted that the lower end attachment portion 77 includes: the lower portion 76*a*2 in the upperside lower attachment portion 76*a*; and the underside lower attachment portion 76*b*. Accordingly, the sliding sealing element 66 extends downwardly along: the upper attachment portion 78; the entire length of the base portion 81 of the sponge seal 65; and the entire length of the lower region 76*a*2 in the upperside lower attachment portion 76; and is finally folded back to further extend rearwardly along the underside lower attachment portion 76*b*. In this way, the sliding sealing element 66 extends not only on the sponge seal 65 but also to extend further upwardly from the upper edge of the sponge seal 65 onto the plate spring 59 and further downwardly from the lower edge of the sponge seal 65 onto the housing, frame 52.

As shown in FIG. 5, the developing roller 31, indicated by the broken line, makes sliding contact with the sliding sealing element 66 at its areas over: a lower portion in the upper attachment portion 78; the sponge seal 65; and the upper region 76*a*1 in the upperside lower attachment portion 76*a*. The developing roller 31 makes no sliding contact with the sliding sealing element 66 at its areas over: an upper portion in the upper attachment portion 78; and the lower end attachment portion 77 (lower region 76*a*2 in the upperside lower attachment portion 76*a* and the underside lower attachment portion 76*b*). In this way, the sliding sealing element 66 is provided to cover not only the region, with which the developing roller 31 makes sliding contact, but also the region, with which the developing roller 31 makes no sliding contact.

It is noted that an overlapping region Y is defined as an area of the rear surface of the sliding sealing element 66 that confronts the sponge seal 65. A first non-overlapping region X-1 is defined as another area of the rear surface of the sliding sealing element 66 that confronts the upper attachment portion 78 on the plate spring 59. A second non-overlapping region X-2 is defined as still another area of the rear surface of the sliding sealing element 66 that confronts the lower end attachment portion 77 (lower region 76*a*1 in the upperside lower attachment portion 76*a* and the underside lower attachment portion 76*b*) on the housing frame 52.

The first non-overlapping region X-1 is located on one longitudinal end of the sliding sealing element 66, and the second non-overlapping region X-2 is located on the other longitudinal end of the sliding sealing element 66. The overlapping region Y is defined as an intermediate area defined between the non-overlapping regions X-1 and X-2. The sliding sealing element 66 is overlapped with the sponge seal 65 at the overlapping region Y, while the sliding sealing element 66 is not overlapped with the sponge seal 65 at the non-overlapping regions X-1 and X-2.

The upper attachment portion 78 has a rectangular shape whose width is equal to the width of the sliding sealing element 66. The first non-overlapping region X-1 also has a rectangular shape whose width is equal to the width of the sliding sealing element 66. The lower end attachment portion 77 has a rectangular shape whose width is equal to the width of the sliding sealing element 66. The second non-overlapping region X-2 also has a rectangular shape whose width is equal to the width of the sliding sealing element 66.

The sliding sealing element 66 is attached to the housing 51 by a first double-faced adhesive tape 84-1 and a second double-faced adhesive tape 84-2. The first and second double-faced adhesive tapes 84-1 and 84-2 are provided on the rear surface of the sliding sealing element 66 to affix the sliding sealing element 66 to the housing 51.

More specifically, the first double-faced adhesive tape 84-1 is provided on the first non-overlapping region X-1 of the rear surface of the sliding sealing element 66, and the second double-faced adhesive tape 84-2 is provided on the second non-overlapping region X-2 of the rear surface of the sliding sealing element 66.

The first double-faced adhesive tape 84-1 is provided entirely over the first non-overlapping region X-1 of the sliding sealing element 66. Accordingly, the first double-faced adhesive tape 84-1 also has a rectangular shape whose width is equal to the width of the sliding sealing element 66 and is uniform in the rotating direction of the developing roller 31.

Similarly, the second double-faced adhesive tape 84-2 is provided entirely over the second non-overlapping region X-2 of the sliding sealing element 66. Accordingly, the second double-faced adhesive tape 84-2 also has a rectangular shape whose width is equal to the width of the sliding sealing element 66 and is uniform in the rotating direction of the developing roller 31.

In this way, the first double-faced adhesive tape 84-1 is located next to the layer-thickness regulating blade 32 in the widthwise direction of the housing 51, and extends upwardly from the upper edge of the sponge seal 65. The second double-faced adhesive tape 84-2 extends downwardly from the lower edge of the sponge seal 65 and is folded back along the underside surface of the housing frame 52.

As shown in FIG. 6(*b*), the second double-faced adhesive tape 84-2 includes: a second base member 84-2*a*; and a pair of second adhesive layers 84-2*b* and 84-2*c*. The second base member 84-2*a* can be made of any material, such as elastic material, non-woven fabric, and PET (polyethylene terephthalate), that has a desired amount of rigidity. The second base member 84-2*a* has a pair of opposite surfaces. The pair of second adhesive layers 84-2*b* and 84-2*c* are made of adhesive agent and provided on the pair of opposite surfaces of the second base member 84-2*a*, respectively. The second adhesive layer 84-2*c* is attached to the sliding sealing element 66. The second adhesive layer 84-2*b* is attached onto the lower end attachment portion 77 of the housing frame 52.

The thickness of the second double-faced tape 84-2 is not particularly limited, but needs to have an amount sufficiently large to fixedly secure the sliding sealing element 66 onto the housing frame 52. More specifically, the thickness of the second base member 84-2*a* has an amount sufficiently large to fixedly secure the sliding sealing element 66 onto the housing frame 52.

The thickness of the first double-faced tape 84-1 has an amount that allows a total thickness of the first double-faced adhesive tape 84-1 and the sliding sealing element 66 to be greater than or equal to the thickness of the layer-thickness regulating blade 32, as shown in FIG. 6(*c*), when the developing roller 31 is not mounted in the housing 51. In this example, the thickness of the layer-thickness regulating blade 32 is 1.5 mm, the thickness of the sliding sealing element 66 is 0.8 mm, and the thickness of the first double-faced adhesive tape 84-1 is 0.8 mm. It is noted that the first double-faced adhesive tape 84-1 can have a thickness in the range of about 0.8 mm to 3 mm.

As shown in FIG. 6(*c*), the layer-thickness regulating blade 32, is located on the front surface, of the plate spring 59 that will confront the developing roller 31 when the developing roller 31 is installed in the housing 51. The sliding sealing element 66 is provided via the first double-faced tape 84-1 on the front surface of the plate spring 59 at the upper attachment portion 78, that is, at a location next to the layer-thickness regulating blade 32. When the developing roller 31 is not installed in the housing 51, the distance or height of the front surface of the sliding sealing element 66 from the front surface of the plate spring 59 is greater than the distance or height of the top surface of the layer-thickness regulating blade 32 from the surface of the plate spring 59.

As shown in FIG. 6(*c*), the first double-faced tape 84-1 includes: a first base member 84-1*a*; and a pair of first adhesive layers 84-1*b* and 84-1*c*. The first base member 84-1*a* is made of elastic material, such as elastic foamed material. Representative examples of the first base member 84-1*a* include a sponge sheet and a urethane sheet. The first base member 84-1*a* has a pair of opposite surfaces. The pair of first adhesive layers 84-1*b* and 84-1*c* are made of adhesive agent and provided on the pair of opposite surfaces of the first base member 84-1*a*, respectively. The first adhesive layer 84-1*c* is attached to the sliding sealing element 66. The first adhesive layer 84-1*b* is attached to the plate spring 59. The thickness of the first base member 84-1*a* is adjusted to allow the total thickness of the first double-faced adhesive tape 84-1 and the sliding sealing element 66 to be greater than or equal to the thickness of the layer-thickness regulating blade 32. In this example, the thickness of the first base member 84-1*a* is greater than the thickness of the second base member 84-2*a*.

When the developing roller 31 is installed in the housing 51, as shown in FIG. 6(*d*), the first base member 84-1*a* is compressed by the developing roller 31 to be elastically deformed due to its elasticity, as a result of which the front surface of the sliding sealing element 66 is brought into the same level with the front surface of the layer-thickness regulating blade 32. This enables the sliding sealing element 66 to block any leakage of toner through the boundary between the layer-thickness regulating blade 32 and the sliding sealing element 66.

It is now assumed that the first base member 84-1*a* were made of non-elastic material and had a thickness relatively small with respect to the layer-thickness regulating blade 32 as shown in FIG. 6(*e*). In such a case, another elastic sheet 184, such as a sponge sheet, and another double-faced adhesive sheet 185 have to be additionally provided between the first double-faced adhesive sheet 84-1 and the plate spring 59, in order to adjust the distance between the front surface of the sliding sealing element 66 and the front surface of the plate spring 59 to be greater than or equal to the distance between the front surface of the layer-thickness regulating blade 32 and the front surface of the plate spring 59. The laminate structure thus provided between the sliding sealing element 66 and the plate spring 59 will become complicated. It will become necessary to perform an additional troublesome work to attach the elastic sheet 184 onto the plate spring 59 via the double-faced adhesive sheet 185, before attaching the sliding sealing element 66 on the elastic sheet 184 via the, first double-faced adhesive tape 84-1.

Contrarily, according to the present embodiment, the first double-faced adhesive tape 84-1 has the first base member 84-1*a* made of elastic material. By simply adjusting the thickness of the first base member 84-1*a* dependently on the layer-thickness regulating blade 32, it becomes unnecessary to provide any separate elastic member or any additional double-faced adhesive tape between the first double-faced adhesive tape 84-1 and the plate spring 59. The configuration of the laminate structure between the sliding sealing element 66 and the plate spring 59 becomes simple.

It is noted that the second base member 84-2*a* in the second double-faced adhesive tape 84-2 may be made of elastic material, such as an elastic foamed material, similarly to the first base member 84-1*a* in the first double-faced adhesive tape 84-1. In this case, the thickness of the second base member 84-2*a* may have the same thickness as that of the first base member 84-1*a* in the first double-faced adhesive tape 84-1. In other words, the thickness of the second base member 84-2*a* may have such a value that allows the total thickness of the double-faced adhesive tape 84-2 and the sliding sealing element 66 to be greater than or equal to the thickness of the layer-thickness regulating blade 32 when the developing roller 31 is not installed in the housing 51.

Next will be described with reference to FIG. 6(*f*) and FIG. 6(*g*) how to attach the sliding sealing element 66 onto the housing 51 during a manufacturing step of the developing cartridge 28.

First, the sliding sealing element 66 is prepared in a state shown in FIG. 6(*f*), in which the first and second double-faced adhesive tapes 84-1 and 84-2 are attached to two lengthwise ends of the sliding sealing element 66. In this example, the first double-faced adhesive tape 84-1 has a thickness greater than the second double-faced adhesive tape 84-2. At this time, the first double-faced adhesive tape 84-1 originally includes not only the first base member 84-1*a* and the first adhesive layers 84-1*b* and 84-1*c* but also a first release paper 84-1*d*. The first release paper 84-1*d* is attached to the first adhesive layer 84-1*b*. The first release paper 84-1*d* is releasable from the first adhesive layer 84-1*b*. The second double-faced adhesive tape 84-2 originally includes not only the second base member 84-2*a* and the second adhesive layers 84-2*b* and 84-2*c* but also the second release paper 84-2*d*. The second release paper 84-2*d* is attached to the second adhesive layer 84-2*b*. The second release paper 84-2*d* is releasable from the second adhesive layer 64-2*b*.

After attaching the side seal 65 on the housing frame 52 via double-faced adhesive tape (not shown) as shown in FIG. 3(*a*), in order to mount the sliding sealing element 66 as partly overlying the side seal 65 as shown in FIG. 3(*b*), the first and second release papers 84-1*d* and 84-2*d* are peeled off from the first and second adhesive layers 84-1*b* and 84-2*b*, respectively. Then, the exposed first adhesive layer 84-1*b* is bonded to the upper attachment portion 78 on the plate spring 59, and the exposed second adhesive layer 84-2*b* is bonded to the lower end attachment portion 77 on the housing frame 52.

During a recycling stage of the developing cartridge 28, the used-up sliding sealing element 66 is separated from the sponge seal 65. Then, a new sliding sealing element 66, on which the first and second double-faced adhesive tapes 84-1 and 64-2 are already attached as shown in FIG. 6(*f*), is mounted as partly overlaying the sponge seal 65 in the same manner as in the manufacturing step.

As described above, according to the present embodiment, the double-faced adhesive tapes 84-1 and 84-2 are provided on both lengthwise edges of the sliding sealing element 66 at its non-overlapping regions X-1 and X-2 where the sliding sealing element 66 does not confront the sponge seal 65. The sliding sealing element 66 is attached to the housing 51 at the upper attachment portion 78 and the lower end attachment portion 77. Accordingly, the sliding sealing element 66 can be fixed reliably to the housing 51, improving the sealing capability.

No double-faced adhesive tape is provided in the overlapping region X where the sliding sealing element 66 confronts the sponge seal 65. During the recycling of the developing cartridge 28, the used-up sliding sealing element 66 can be separated cleanly from the sponge seal 65. Since the used sliding sealing element 66 can thus be separated from the sponge seal 65 without damaging the sponge seal 65, it is unnecessary to replace the sponge seal 65 with a new one. The efficiency with which the developing cartridge 28 is recycled can be improved and thus the cost thereof can be reduced. Running costs of the developing cartridge 28, of the process cartridge 17, and of the laser printer 1 can be reduced. The amount of waste can be reduced.

Since each sliding sealing element 66 is affixed by the double-faced adhesive tapes 64-1 and 84-2 at the two lengthwise end portions thereof along the rotating direction of the developing roller 31, the end portions of the sliding sealing element 66 can be fixed reliably onto the housing 51. The sealing capability can be improved while ensuring simple removal of the sliding sealing element 66 from the sponge seal 65.

The sliding sealing element 66 is attached to the housing 51 at the upper portion of the upper attachment portion 78 and the lower end attachment portion 77, at both of which the sliding sealing element 66 does not make sliding contact with the developer roller 31. In this way, the sliding sealing element 66 is attached to the housing 51 at its portions that will be deteriorated little with time. The sealing capability can be further improved by affixing the sliding sealing element 66 at these portions.

The upper attachment portion 78 is defined as a location on the plate spring 59 adjacent to an edge of the layer-thickness regulating blade 32 in the axial direction of the developing roller 31. Toner is most likely to leak at the upper attachment portion 78. According to the present embodiment, the sliding sealing element 66 is securely attached to the plate spring 59 at the upper attachment portion 78 via the first double-faced adhesive tape 84-1. Accordingly, it is possible to reliably prevent the leakage of toner from the portion at which toner is most likely to leak, enabling an improvement in the sealing capability.

The first double-faced adhesive tape 84-1 has a sufficiently large thickness that the total thickness of the first double-faced adhesive tape 84-1 and the sliding sealing element 66 is greater than or equal to the thickness of the layer-thickness regulating blade 32. The first base member 84-1*a* in the first double-faced adhesive tape 84-1 is made of elastic material. When the developing roller 31 is mounted in position in the developing cartridge 28, the first base member 84-1*a* is properly compressed, and the sliding sealing element 66 is intimately and slidingly contact with the developing roller 31, thereby properly blocking any leakage of toner from the layer-thickness regulating blade 32. It is possible to prevent toner leakage even more reliably.

<First Modification>

Figure 7:
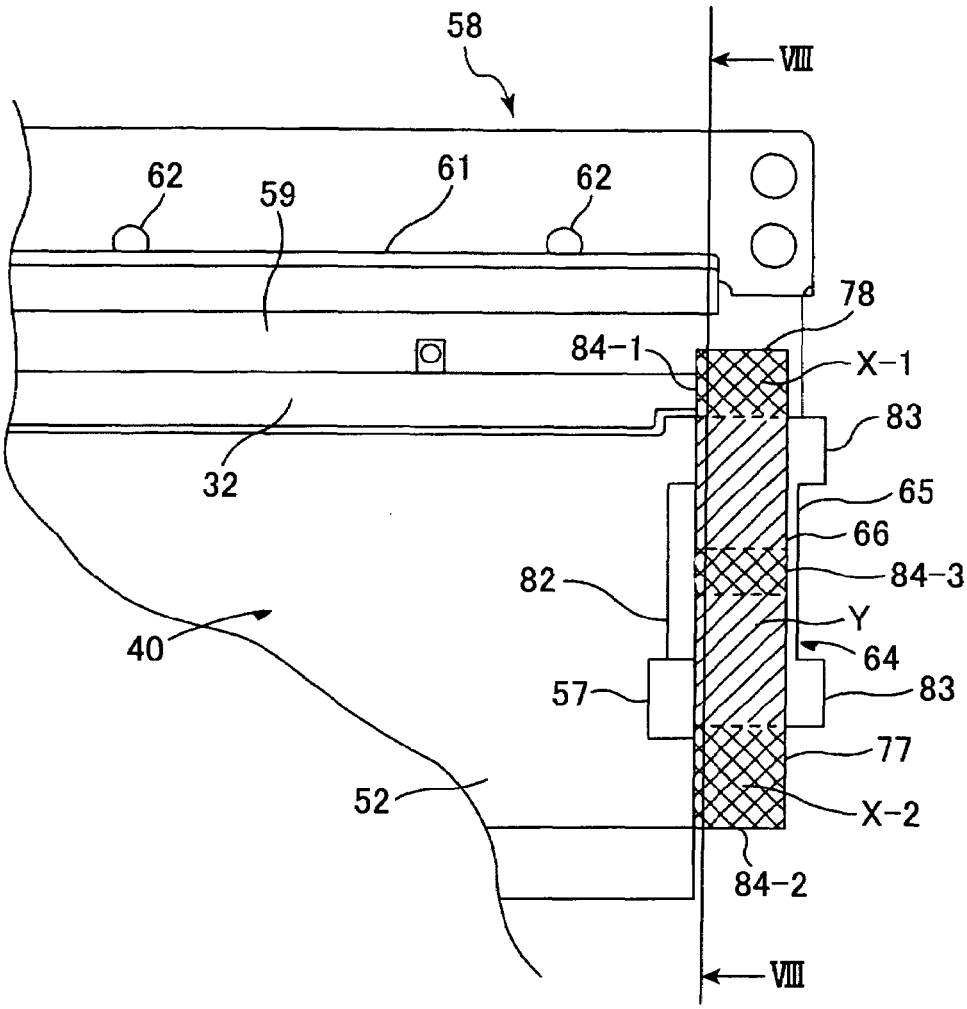
FIG. 7 is a front view of the end of the developing cartridge seen from a direction indicated by an arrow IV in FIG. 3(*b*) according to a first modification.
Figure 8:
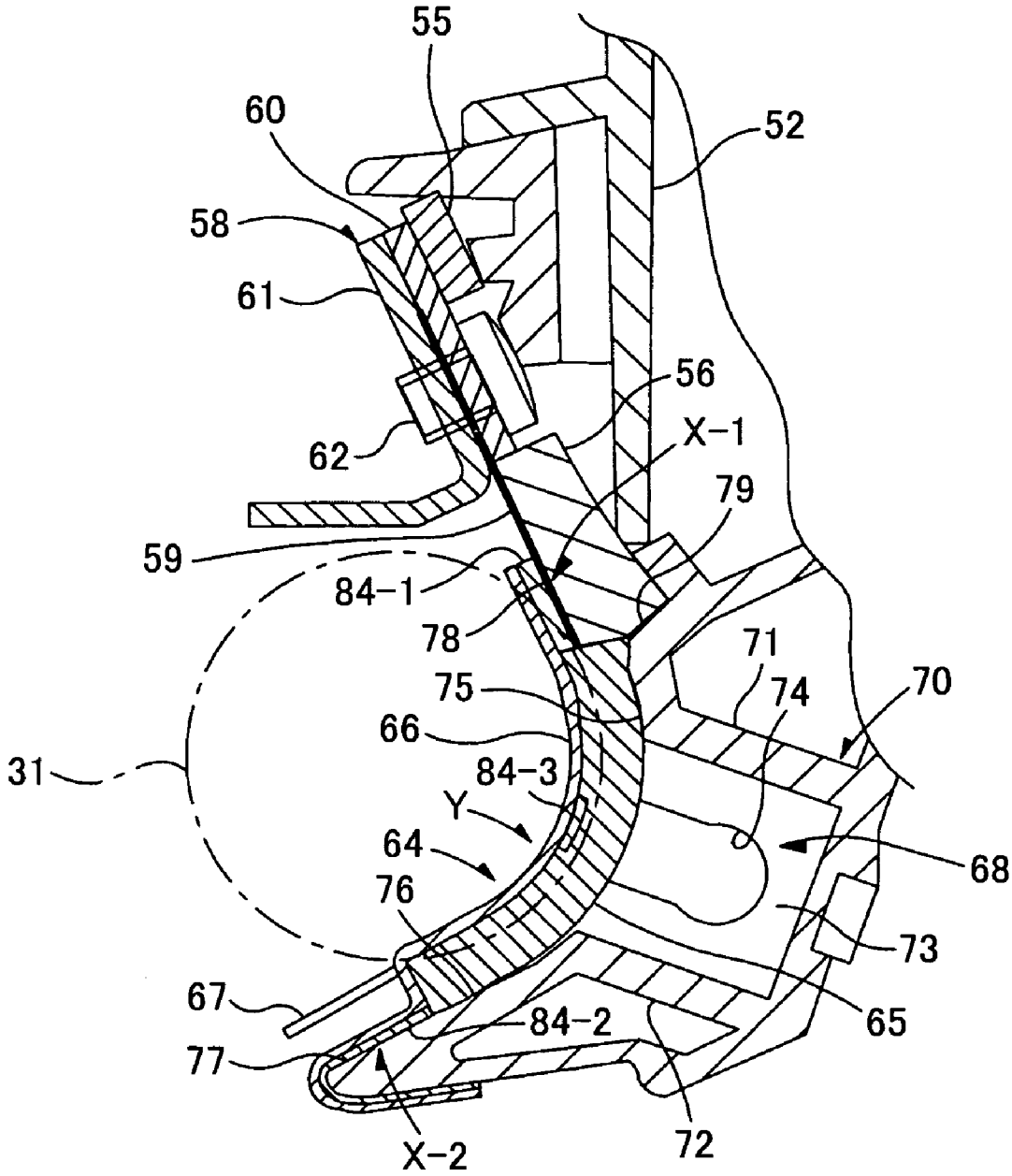
FIG. 8 is a side sectional view of the sealing structure, taken along a line VIII—VIII in FIG. 7.
Figure 9:
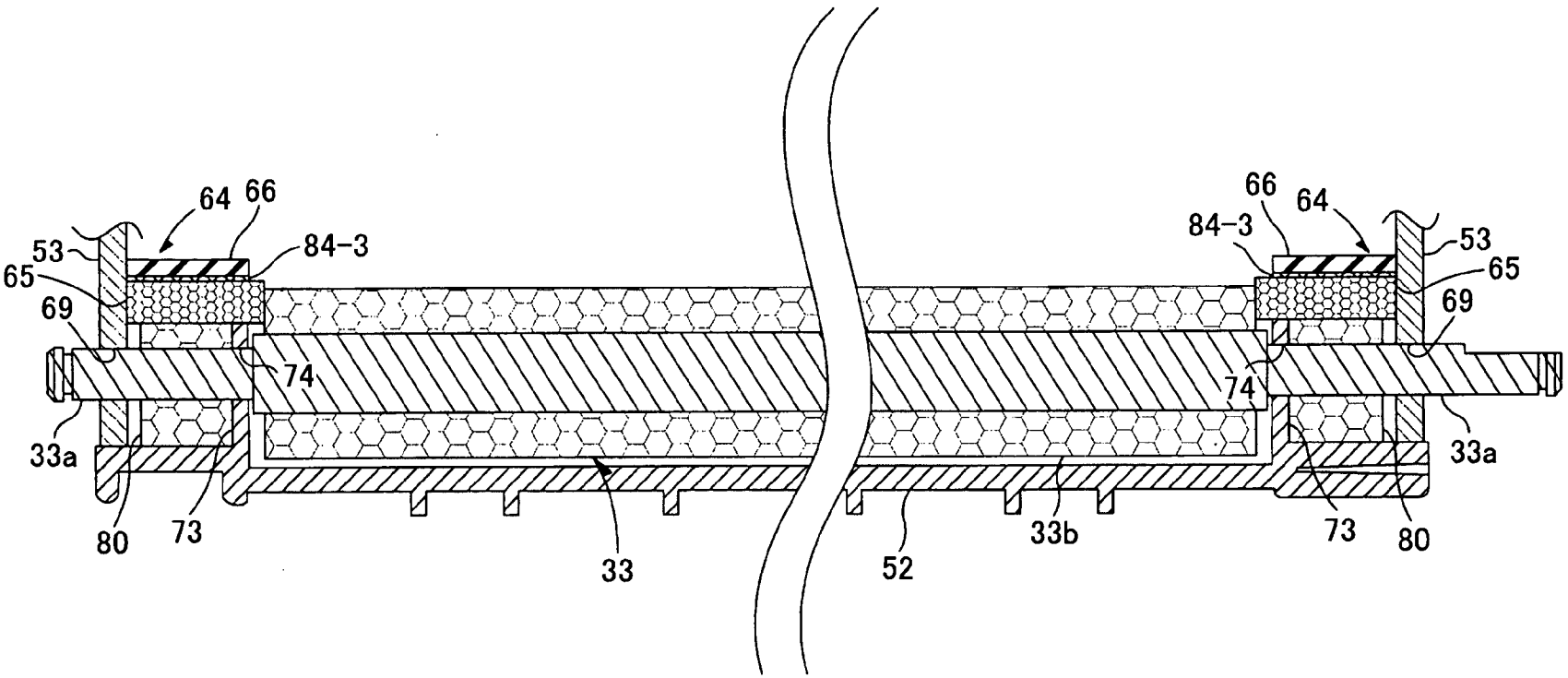
FIG. 9 is a cross-sectional view of the sealing structure and the supply roller, taken along a line VIa—VIa in FIG. 2(*b*) according to the first modification, where showing of the developing roller is omitted.

In the above-described embodiment, the first and second double-faced adhesive tapes 84-1 and 84-2 are provided on the rear side of the sliding sealing element 66 only at the non-overlapping portions X-1 and X-2, that is, only at both of the longitudinal end portions of the sliding sealing element 66. However, according to a first modification of the embodiment, as shown in FIG. 7, FIG. 8, and FIG. 9, in addition to the first and second double-faced adhesive tapes 84-1 and 84-2, a third double-faced adhesive tape 84-3 is additionally provided on the rear surface of the sliding sealing element 66. The third double-faced adhesive tape 84-3 is located at an intermediate portion within the overlapping region Y, that is, at a longitudinal central portion of the sliding sealing element 66, with predetermined spacings in the longitudinal direction from the first and second double-faced adhesive tapes 84-1 and 84-2, respectively.

By attaching the lengthwise middle portion of the sliding sealing element 66 onto the sponge seal 65 and by attaching both the lengthwise ends of the sliding sealing element 66 onto the upper attachment portion 78 and the lower end attachment portion 77 of the housing 51, it is possible to securely attach the sliding sealing element 66 to the housing 51, thereby further improving sealing capability. It is possible to prevent the sliding sealing element 66, from being mistakenly separated from the sponge seal 65.

The third double-faced adhesive tape 84-3 is formed in a substantially rectangular shape, and is provided to cover the entire width of the sliding sealing element 66. The width of the third double-faced adhesive tape 84-3 is the same as the width of the sliding sealing element 66, and is unchanged along the lengthwise direction of the sliding sealing element 66.

The surface area of a portion in the rear surface of of the sliding sealing element 66, onto which the third double-faced adhesive tape 84-3 is attached, is less than a half of the entire surface area of the overlapping portion Y where the sliding sealing element 66 confronts the sponge seal 65.

The surface area of the sliding sealing element 66, onto which the third double-faced adhesive tape 84 is attached, is sufficiently small that during the recycling step, the third double-faced adhesive tape 84-3 can be peeled off the sponge seal 65 while reducing damage onto the sponge seal 65. During the recycling step, it is possible to maintain small the possibility that the sponge seal 65 will be damaged when the third double-faced adhesive tape 84-3 is peeled off the sponge seal 65. It is therefore possible to maintain small the possibility that the sponge seal 65 will have to be replaced with a new one.

The double-faced adhesive tape 84-3 may have the same configuration as the first double-faced adhesive tape 84-1. That is, the double-faced adhesive tape 84-3 may have an elastic base member, which is made of elastic foamed material, for example, between a pair of adhesive layers. In this case, the thickness of the elastic base member in the double-faced adhesive tape 84-3 may have such a value that allows the total thickness of the double-faced adhesive tape 84-3 and the sliding sealing element 66 to be greater than or equal to the thickness of the layer-thickness regulating blade 32 when the developing roller 31 is not installed in the housing 51.

Similarly to the embodiment as described above with reference to FIGS. 6(*f*) and 6(*g*), for the manufacturing and recycling stages, the sliding sealing element 66 may be prepared in a state in which the first, second, and third double-faced adhesive tapes 84-1, 84-2, and 84-3 are attached on the sliding sealing element 66 at its corresponding locations. At this time, similarly to the first and second double-faced adhesive tapes 84-1 and 84-2, the third double-faced adhesive tape 84-3 originally includes not only its base member and its pair of adhesive layers but also its release paper that is releasably attached to one of the adhesive layers. By releasing the release paper from the third double-faced adhesive tape 84-3, the third double-faced adhesive tapes 84-3 can be attached to the sponge seal 65.

<Second Modification>

Figure 10:
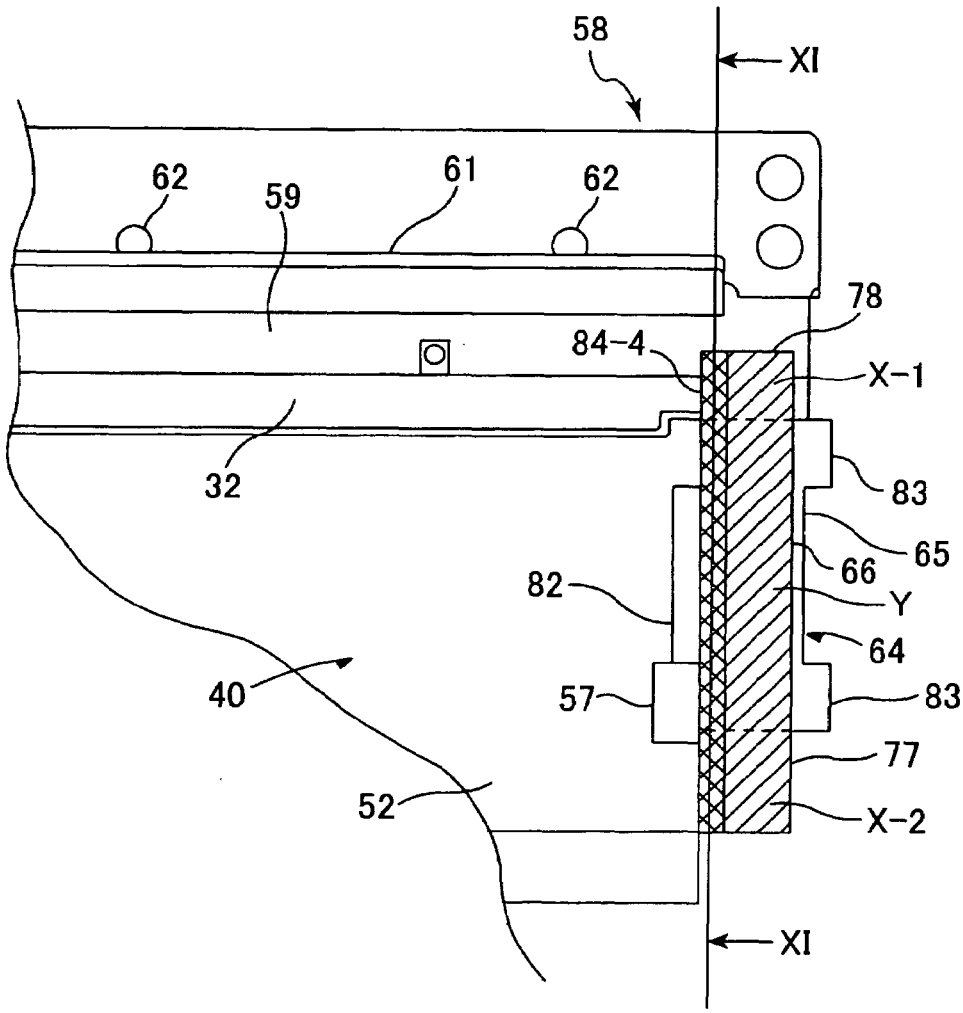
FIG. 10 is a front view showing the end of the developing cartridge seen from a direction indicated by the arrow IV in FIG. 3(*b*) according to a second modification.
Figure 11:
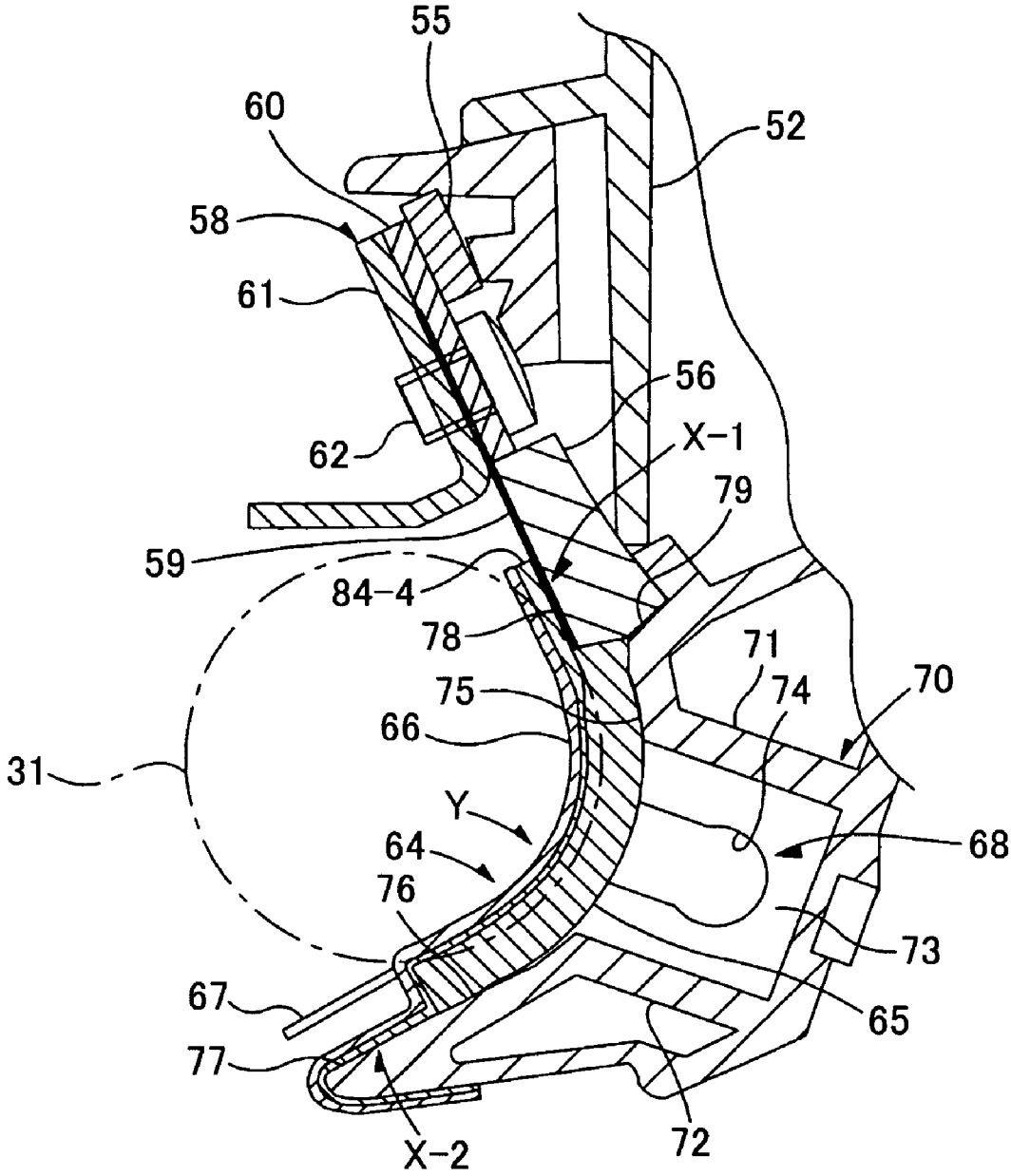
FIG. 11 is a side sectional view of the sealing structure, taken along a line XI—XI in FIG. 10.
Figure 12:
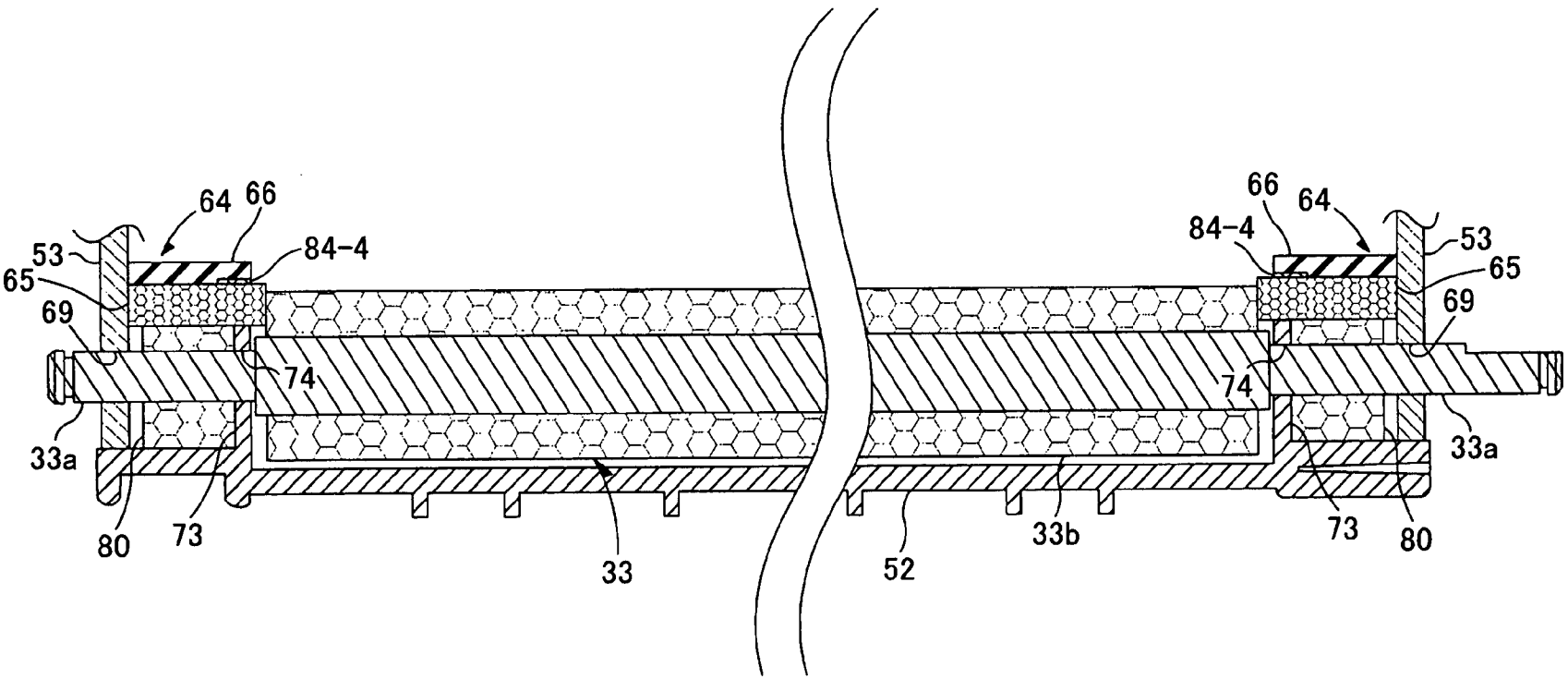
FIG. 12 is a cross-sectional view of the sealing structure and the supply roller, taken along a line VIa—VIa in FIG. 2(*b*) according to the second modification, where showing of the developing roller is omitted.

According to a second modification of the present embodiment, as shown in FIG. 10, FIG. 11, and FIG. 12, a single double-faced adhesive tape 84-3 is provided to extend continuously over the entire length of the sliding sealing element 66 at one widthwise edge of the sliding sealing element 66, that is, at an inner-side widthwise edge of the sliding sealing element 66 that is more adjacent to the layer thickness regulating blade 32 than the other, outer-side widthwise edge. In this case, the double-faced adhesive tape 84-4 is provided continuously over all of the non-overlapping regions X-1 and X-2 and the overlapping region Y in its lengthwise direction. Accordingly, it is possible to prevent the sliding sealing element 66 from being easily peeled off the housing 51.

The double-faced adhesive tape 84-4 is formed in a substantially rectangular shape, and is provided to extend over the entire length of the sliding sealing element 66. The width of the double-faced adhesive tape 84-4 is unchanged along the lengthwise direction of the sliding sealing element 66. It is possible to easily form the double-faced adhesive tape 84-4. It is possible to easily attach the double-faced adhesive tape 84-4 onto the sliding sealing element 66. It is possible to easily attach the sliding sealing element 66 via the double-faced adhesive tape 84-4 onto the housing 51.

The width of the double-faced adhesive tape 84-4 has such a sufficiently small value that allows the surface area of a portion in the overlapping region Y of the sliding sealing element 66, to which a part of the double-faced adhesive tape 84-4 is attached, to be less than a half of the entire surface area of the overlapping portion y where the sliding sealing element 66 confronts the sponge seal 65. The double-faced adhesive tape 84-4 can be peeled off the sponge seal 65 while reducing damage onto the sponge seal 65.

The sliding sealing element 66 is attached to the housing 51 at its inner side edge that is located adjacent to the layer-thickness regulating blade 32. It is possible to prevent leakage of toner at the location between the inner side widthwise edge of the sliding sealing element 66 and the layer-thickness regulating blade 32, where toner leakage occurs most likely.

The double-faced adhesive tape 84-4 has the same configuration as the first double-faced adhesive tape 84-1 in the embodiment. That is, the double-faced adhesive tape 84-4 has an elastic base member, which is made of elastic foamed material, for example, between a pair of adhesive layers. The thickness of the elastic base member in the double-faced adhesive tape 84-4 has such a value that allows the total thickness of the double-faced adhesive tape 84-4 and the sliding sealing element 66 to be greater than or equal to the thickness of the layer-thickness regulating blade 32 when the developing roller 31 is not installed in the housing 51.

Similarly to the embodiment as described above with reference to FIGS. 6(*f*) and 6(*g*), for the manufacturing and recycling stages, the sliding sealing element 66 may be prepared in a state in which the double-faced adhesive tape 84-4 is attached on the sliding sealing element 66 at its one widthwise edge. At this time, similarly to the first and second double-faced adhesive tapes 84-1 and 84-2 in the embodiment, the double-faced adhesive tape 84-4 originally includes not only its base member and its pair of adhesive layers but also its release paper that is releasably attached to one of the adhesive layers. By releasing the release paper from the double-faced adhesive tape 84-4, the double-faced adhesive tape 84-4 can be attached to the upper attachment portion 78 on the plate spring 59, the sponge seal 65, and the lower end attachment portion 77 on the housing frame 52.

<Third Modification>

Figure 13:
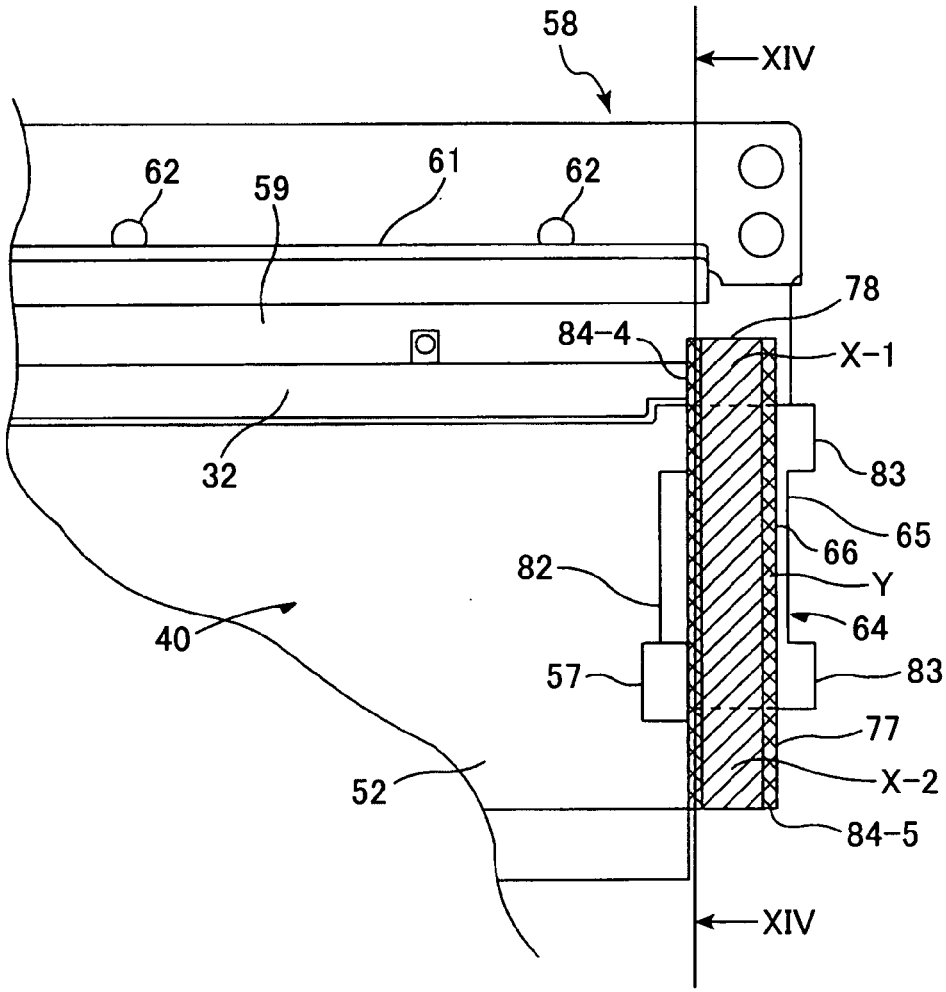
FIG. 13 is a front view showing the end of the developing cartridge seen from a direction indicated by an arrow IV in FIG. 3(*b*) according to a third modification.
Figure 14:
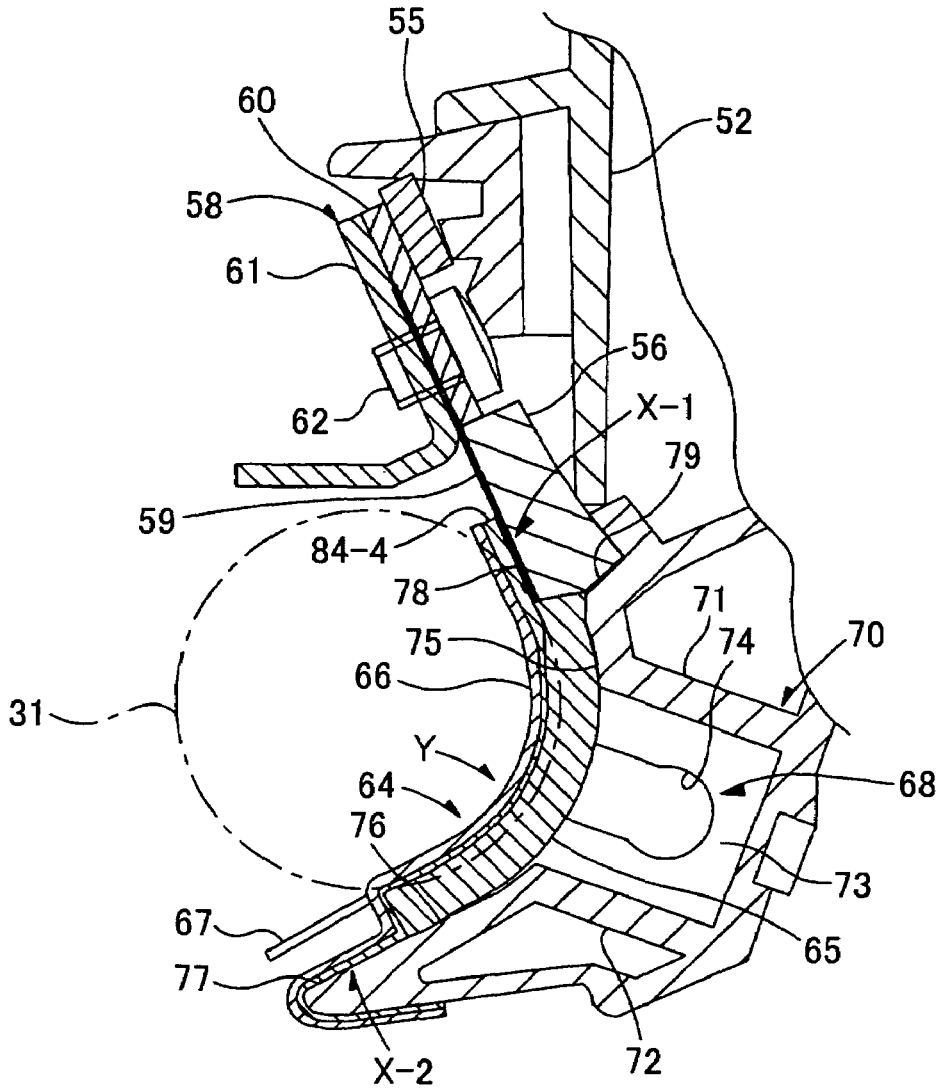
FIG. 14 is a side sectional view of the sealing structure, taken along a line XIV—XIV in FIG. 13.
Figure 15:
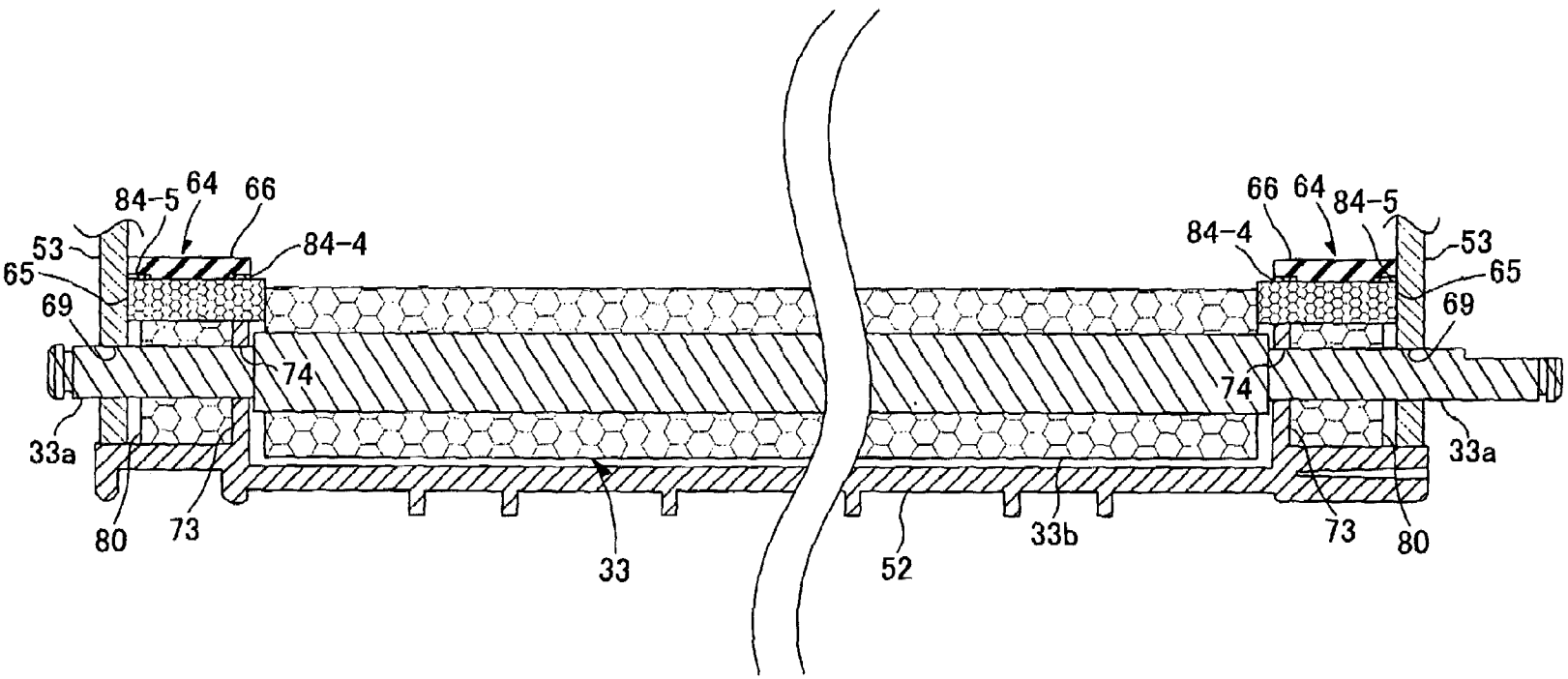
FIG. 15 is a cross-sectional view of the sealing structure and the supply roller, taken along a line VIa—VIa in FIG. 2(*b*) according to the third modification, where showing of the developing roller is omitted.

According to a third modification of the present embodiment, as shown in FIG. 13, FIG. 14, and FIG. 15, not only the double-faced adhesive tape 84-4 is provided to extend continuously over the entire length of the sliding sealing element 66 at the inner-side widthwise edge of the sliding sealing element 66, but also another double-faced adhesive tape 84-5 is provided to extend continuously over the entire length of the sliding sealing element 66 at the outer-side widthwise edge of the sliding sealing element 66. By attaching the sliding sealing element 66 at its both widthwise edges to the housing 51, the sliding sealing element 66 can attain further improved sealing capability.

Similarly to the double-faced adhesive tape 84-4, the double-faced adhesive tape 84-5 is formed in a substantially rectangular shape, and is provided to extend over the entire length of the sliding sealing element 66. Similarly to the double-faced adhesive tape 84-4, the width of the double-faced adhesive tape 84-4 is unchanged along the lengthwise direction of the sliding sealing element 66. It is possible to easily form the double-faced adhesive tape 84-5. It is possible to easily attach the double-faced adhesive tape 84-5 onto the sliding sealing element 66. It is possible to easily attach the sliding sealing element 66 via the double-faced adhesive tapes 84-4 and 84-5 onto the housing 51.

The widths of the double-faced adhesive tapes 84-4 and 84-5 have such sufficiently small values that allow the total surface area of the portions in the overlapping region Y of the sliding sealing element 66, onto which parts of the double-faced adhesive tapes 84-4 and 84-5 are attached, to be less than a half of the entire surface area of the overlapping portion Y where the sliding sealing element 66 confronts the sponge seal 65. The double-faced adhesive tapes 84-4 and 84-5 can be separated from the sponge seal 65 while reducing damage onto the sponge seal 65.

The sliding sealing element 66 is attached to the housing 51 at its inner side widthwise edge that is located adjacent to the layer-thickness regulating blade 32. It is possible to prevent leakage of toner at the location between the inner side widthwise edge of the sliding sealing element 66 and the layer-thickness regulating blade 32, where toner leakage occurs most likely.

Similarly to the double-faced adhesive tape 84-4, the double-faced adhesive tape 84-5 has the same configuration as the first double-faced adhesive tape 84-1 in the embodiment. That is, the double-faced adhesive tape 84-5 has an elastic base member, which is made of elastic foamed material, for example, between a pair of adhesive layers. The thickness of the elastic base member in the double-faced adhesive tape 84-5 has such a value that allows the total thickness of the double-faced adhesive tape 84-5 and the sliding sealing element 66 to be greater than or equal to the thickness of the layer-thickness regulating blade 32 when the developing roller 31 is not installed in the housing 51.

Similarly to the embodiment as described above with reference to FIGS. 6(*f*) and 6(*g*), for the manufacturing and recycling stages, the sliding sealing element 66 may be prepared in a state in which the double-faced adhesive tapes 84-4 and 84-5 are attached on the sliding sealing element 66 at its both widthwise edges. At this time, similarly to the first and second double-faced adhesive tapes 84-1 and 84-2 in the embodiment, each of the double-faced adhesive tapes 84-4 and 84-5 originally includes not only its base member and its pair of adhesive layers but also its release paper that is releasably attached to one of the adhesive layers. By releasing the release papers from the double-faced adhesive tapes 84-4 and 84-5, the double-faced adhesive tapes 84-4 and 84-5 can be attached to the upper attachment portion 78 on the plate spring 59, the sponge seal 65, and the lower end attachment portion 77 on the housing frame 52.

While the invention has been described in detail with reference to the specific embodiment thereof, it would be apparent to those skilled in the art that various changes and modifications may be made therein without departing from the spirit of the invention.

For example, in the above-described embodiment, the sliding sealing element 66 is formed from a fluoride-based felt. However, the sliding sealing element 66 can be formed from other materials, such as woven cloth, knit, hair implant, or non-woven material.

In addition, in the above-described embodiment, the upper attachment portion 78 is defined on the plate spring member 59. However, the upper attachment portion 78 may not be defined on the plate spring member 59, but may be defined on the housing 51 at a location above the location where the sponge seal 66 is attached.

For example, the upper attachment portion 78 may be defined on the housing frame 52 at a location above the sponge seal 66. The first non-overlapping region X-1 is defined on a portion of the rear surface of the sliding sealing element 66 that confronts the upper attachment portion 78. Or, the upper attachment portion 78 may be defined on a portion, of any member in the housing 51 other than the housing frame 52 and the sponge seal 66, that is located above the upper edge of the sponge seal 66. The first non-overlapping region X-1 is defined on a portion of the rear surface of the sliding sealing element 66 that confronts the upper attachment portion 78.

In the above-described embodiment, the lower end attachment-portion 77 is defined on the housing frame 52. However, the lower end attachment portion 77 may be defined on a portion, of any member in the housing 51 other than the housing frame 52 and the sponge seal 66, that is located below the lower edge of the sponge seal 66. The non-overlapping portion X-2 is defined on the rear surface of the sliding sealing element 66 as its portion that confronts the lower end attachment portion 77.

In the second modification, the double-faced adhesive tape 84-4 is provided at the inner side widthwise edge of the sliding sealing element 66. However, the double-faced adhesive tape 84-4 may be provided at any regions on the rear surface of the sliding sealing element 66 if the double-faced adhesive tape 84-4 covers at least a part of the first non-overlapping region X-1 of the sliding sealing element 66 that confronts the upper attachment portion 78 on the plate spring 59. Also in-this case, the double-faced adhesive tape 84-4 has the same configuration as the first double-faced adhesive tape 84-1 in the embodiment, and therefore has an elastic base member, which is made of elastic foamed material, for example, between a pair of adhesive layers. The thickness of the elastic base member in the double-faced adhesive tape 84-4 has such a value that allows the total thickness of the double-faced adhesive tape 84-4 and the sliding sealing element 66 to be greater than or equal to the thickness of the layer-thickness regulating blade 32 when the developing roller 31 is not installed in the developing cartridge 28. Accordingly, when the developing roller 31 is installed in the developing cartridge 28, the double-faced adhesive tape 84-4 is compressed against the circumferential surface of the developing roller 31 and is deformed elastically. It is possible to prevent any leakage of toner between the circumferential surface of the developing roller 31 and the double-faced adhesive tape 84-4.

What is claimed is:

1. A sliding sealing element, comprising:

a rectangular-shaped flat sheet; and a first double-faced adhesive tape attached to at least a first location on a surface of the rectangular-shaped flat sheet, the first double-faced adhesive tape including:

a first base member made of elastic material and having a pair of opposite surfaces;

a pair of first adhesive layers made of adhesive agent and provided on the pair of opposite surfaces of the first base member, one of the pair of first adhesive layers being attached to the rectangular-shaped flat sheet; and a first release paper attached to the other one of the pair of first adhesive layers, the first release paper being releasable from the other one of the pair of first adhesive layers.

2. The sliding sealing element as claimed in claim 1, wherein the first base member has a first thickness, and further comprising:

a second double-faced adhesive tape attached to a second location on the surface of the rectangular-shaped flat sheet, the second location being separated from the first location, the second double-faced adhesive tape including:

a second base member having a pair of opposite surfaces, the second base member having a second thickness smaller than the first thickness;

a pair of second adhesive layers made of adhesive agent and provided on the pair of opposite surfaces of the second base member, one of the pair of second adhesive layers being attached to the rectangular-shaped flat sheet; and a second release paper attached to the other one of the pair of second adhesive layers, the second release paper being releasable from the other one of the pair of second adhesive layers.

3. The sliding sealing element as claimed in claim 1, wherein the first base member is made of elastic porous material.

4. A developing cartridge, comprising:

a housing that accommodates developer therein and that is formed with an opening;

a developing member that holds the developer on a surface thereof, the developing member being movably supported in the housing to be exposed at the opening; and a pair of sealing elements provided on the housing at a pair of portions confronting both lengthwise ends of the developing member to prevent leakage of the developer out of the housing by being compressed by the developing member, each sealing element including:

an elastic seal member supported in the housing at a portion confronting a corresponding lengthwise end of the developing member;

a sliding sealing element having a first surface and a second surface opposite to the first surface, the first surface having an overlapping region that confronts a part of the elastic seal member and a non-overlapping region that confronts a part of the housing, at least a part of the second surface making a sliding contact with the surface of the developing member; and an adhesive member provided on at least a part of the non-overlapping region in the first surface of the sliding sealing element thereby being located between the sliding sealing element and the housing, at least a part of the overlapping region in the first surface of the sliding sealing element directly confronting the elastic seal member with no adhesive member being positioned between the at least a part of the overlapping region of the sliding sealing element and the elastic seal member.

5. The developing cartridge as claimed in claim 1, wherein the entire overlapping region in the first surface of the sliding sealing element directly confronts the elastic seal member with no adhesive member being positioned between the entire overlapping region of the sliding sealing element and the elastic seal member.

6. The developing cartridge as claimed in claim 1, wherein the adhesive member is provided on a part of the overlapping region in the first surface of the sliding sealing element thereby being located between the sliding sealing element and the elastic seal member, while allowing a remaining part of the overlapping region to directly confront the elastic seal member with no adhesive member being positioned between the remaining part in the overlapping region of the sliding sealing element and the elastic seal member.

7. The developing cartridge as claimed in claim 6, wherein the part of the overlapping region where the adhesive member is provided has an area less than a half of the entire area of the overlapping region.

8. The developing cartridge as claimed in claim 6, wherein the sliding sealing element is elongated in a moving direction of the developing member that is orthogonal to the lengthwise direction of the developing member, the sliding sealing element having the first non-overlapping region at its one longitudinal end and having the second non-overlapping region at its other longitudinal end, the overlapping region being located between the first and second non-overlapping region, and wherein the adhesive member includes:

a first adhesive member provided on the first non-overlapping region;

a second adhesive member provided on the second non-overlapping region; and a third adhesive member provided on a part of the overlapping region, while allowing another remaining area in the overlapping region of the first surface of the sliding sealing element directly confronting the elastic seal member.

9. The developing cartridge as claimed in claim 8, wherein each of the first through third adhesive members extends in the moving direction of the developing member, while having a uniform width along the moving direction of the developing member, the width being defined in a direction orthogonal to moving direction.

10. The developing cartridge as claimed in claim 9, wherein the third adhesive member is provided on the overlapping region at an area that is distant from both the first and second adhesive members, thereby allowing an area in the overlapping region between the third adhesive member and the first adhesive member and another area in the overlapping region between the third adhesive member and the second adhesive member to directly confront the elastic seal member.

11. The developing cartridge as claimed in claim 10, wherein the first through third adhesive members have the widths equal to the width of the sliding sealing element.

12. The developing cartridge as claimed in claim 6, wherein the sliding sealing element is elongated in a moving direction of the developing member that is orthogonal to the lengthwise direction of the developing member, the sliding sealing element having the first non-overlapping region at its one longitudinal end and having the second non-overlapping region at its other longitudinal end, the overlapping region being located between the first and second non-overlapping region, and wherein the adhesive member includes a first continuous adhesive member that extends continuously in the moving direction of the developing member along the first non-overlapping region, the overlapping region, and the second non-overlapping region.

13. The developing cartridge as claimed in claim 12, wherein the sliding sealing element has an outer widthwise edge that confronts a corresponding lengthwise end of the developing member and an inner widthwise edge that is distant from the outer widthwise edge and that confronts a part of the developing member that is located between the lengthwise ends of the developing member, and wherein the first continuous adhesive member is located on the first surface of the sliding sealing element while extending continuously along the inner widthwise edge of the sliding sealing element.

14. The developing cartridge as claimed in claim 13, wherein the sliding sealing element has a width in the lengthwise direction of the developing member, and wherein the first continuous adhesive member has a first width in the lengthwise direction of the developing member, the first width being smaller than the width of the sliding sealing element and being uniform along the moving direction of the developing member.

15. The-developing cartridge as claimed in claim 13, wherein the adhesive member further includes a second continuous adhesive member that extends continuously in the moving direction of the developing member along the first non-overlapping region, the overlapping region, and the second non-overlapping region, the second continuous adhesive member being located on the first surface of the sliding sealing element while extending continuously along the outer widthwise edge of the sliding sealing element.

16. The developing cartridge as claimed in claim 15, wherein the sliding sealing element has a width in the lengthwise direction of the developing member, and wherein the second continuous adhesive member has a second width in the lengthwise direction of the developing member, the second width being smaller than the width of the sliding sealing element and being uniform along the moving direction of the developing member.

17. The developing cartridge as claimed in claim 1, wherein the housing includes:

a housing frame that accommodates the developer therein and that is formed with the opening, the developing member being movably supported in the housing frame to be exposed at the opening, the pair of sealing elements being provided on the housing frame at the pair of portions confronting both lengthwise ends of the developing member; and a resilient plate attached to the housing frame at one edge of the opening, a layer thickness regulating member being provided on a part of the resilient plate to contact a portion of the surface of the developing member that is defined between the lengthwise ends of the developing member to regulate a thickness of the developer held on the developing member, wherein the non-overlapping region of the first surface of the sliding sealing element includes a first non-overlapping region that confronts another part of the resilient plate that is located adjacent to the part of the resilient member where the layer thickness regulating member is provided, and wherein the adhesive member is provided on at least a part of the first non-overlapping region, thereby being located between the sliding sealing element and the resilient plate.

18. The developing cartridge as claimed in claim 17, wherein a total thickness of the adhesive member provided on the at least the part of the first non-overlapping region and the sliding sealing element is greater than or equal to a thickness of the layer thickness regulating member.

19. The developing cartridge as claimed in claim 18, wherein the adhesive member provided on the at least a part of the first non-overlapping region includes a double-faced adhesive tape, and wherein the double-faced adhesive tape includes:

a first base member made of elastic material and having a pair of opposite surfaces, the first base member having a first thickness; and a pair of first adhesive layers made of adhesive agent and provided on the pair of opposite surfaces of the first base member, the pair of first adhesive layers being attached to the sliding sealing element and the resilient plate, respectively, and wherein the first thickness has an amount that allows the total thickness of the double-faced adhesive tape and the sliding sealing element to be greater than or equal to the thickness of the layer thickness regulating member when the developing member is not mounted in the housing.

20. The developing cartridge as claimed in claim 17, wherein the non-overlapping region of the first surface of the sliding sealing element further includes a second non-overlapping region confronting a part of the housing frame, an additional adhesive member being further provided on at least a part of the second non-overlapping region, thereby being located between the sliding sealing element and the housing frame.

21. The developing cartridge as claimed in claim 20, wherein the additional adhesive member provided on the at least a part of the second non-overlapping region includes an additional double-faced adhesive tape, and wherein the additional double-faced adhesive tape includes:

a second base member having a pair of opposite surfaces, the second base member having a second thickness; and a pair of second adhesive layers made of adhesive agent and provided on the pair of opposite surfaces of the second base member, the pair of second adhesive layers being attached to the sliding sealing element and the housing frame, respectively, and wherein the second thickness is smaller than the first thickness.

22. The developing cartridge as claimed in claim 20, wherein a part of the second surface that opposes the overlapping region on the first surface makes a sliding contact with the surface of the developing member, a part of the second surface that opposes the at least a part of the first non-overlapping region on the first surface fails to make a sliding contact with the surface of the developing member, and a part of the second surface that opposes the at least a part of the second non-overlapping region on the first surface fails to make a sliding contact with the surface of the developing member.

23. The developing cartridge as claimed in claim 22, wherein the sliding sealing element is elongated in a moving direction of the developing member that is orthogonal to the lengthwise direction of the developing member, the sliding sealing element having the first non-overlapping region at its one longitudinal end and having the second non-overlapping region at its other longitudinal end, the overlapping region being located between the first and second non-overlapping region.

24. A process cartridge, comprising:

the developing cartridge claimed in claim 1; and a photosensitive member that confronts the developing member exposed in the opening of the developing cartridge and that bears thereon an electrostatic latent image which is developed by the developing cartridge.

25. An image forming device, comprising:

the developing cartridge claimed in claim 1;

a photosensitive member that confronts the developing member exposed in the opening of the developing cartridge and that bears thereon an electrostatic latent image which is developed by the developing cartridge;

a recording medium conveying mechanism that conveys a recording medium; and a transfer member that transfers the developed image onto the recording medium conveyed by the recording medium conveying mechanism.

* * * * *